US006414331B1

(12) United States Patent
Smith et al.

(10) Patent No.: US 6,414,331 B1
(45) Date of Patent: Jul. 2, 2002

(54) CONTAINER FOR TRANSPORTING ANTIPROTONS AND REACTION TRAP

(76) Inventors: Gerald A. Smith, 12150 N. 137th Way, Scottsdale, AZ (US) 85259; Raymond A. Lewis, 1308 Andover Dr., Boalsburg, PA (US) 16827; Steven D Howe, 19 Karen Cir., Los Alamos, NM (US) 87544

( * ) Notice: Subject to any disclaimer, the term of this patent is extended or adjusted under 35 U.S.C. 154(b) by 0 days.

(21) Appl. No.: 09/535,223

(22) Filed: Mar. 27, 2000

Related U.S. Application Data

(63) Continuation-in-part of application No. 09/405,774, filed on Sep. 27, 1999, now Pat. No. 6,160,263, which is a continuation-in-part of application No. 09/046,064, filed on Mar. 23, 1998, now Pat. No. 5,977,554.

(51) Int. Cl.[7] ..... H05H 13/00

(52) U.S. Cl. ..... 250/493.1; 376/127; 376/156; 313/62

(58) Field of Search ..... 250/493.1, 503.1, 250/281, 292, 423 R, 306; 376/127, 129, 130, 156; 313/62

(56) References Cited

U.S. PATENT DOCUMENTS

| | | | | |
|---|---|---|---|---|
| 3,986,026 A | * 10/1976 | Martin | 250/306 |
| 4,139,777 A | 2/1979 | Rautenbach | 250/499 |
| 4,507,616 A | 3/1985 | Blosser et al. | 328/234 |
| 4,639,634 A | 1/1987 | Meyrand | 313/62 |
| 4,641,104 A | 2/1987 | Blosser et al. | 328/234 |
| 4,771,208 A | 9/1988 | Jongen et al. | 313/62 |
| 4,867,939 A | 9/1989 | Deutch | 376/156 |
| 4,943,781 A | 7/1990 | Wilson et al. | 328/234 |
| 5,139,731 A | 8/1992 | Hendry | 376/112 |
| 5,206,506 A | 4/1993 | Kirchner | 250/281 |
| 5,241,244 A | 8/1993 | Cirri | 315/111.41 |
| 5,463,291 A | 10/1995 | Carroll et al. | 315/502 |
| 5,468,355 A | 11/1995 | Shefer et al. | 204/157.2 |
| 5,521,469 A | 5/1996 | Laisné | 315/502 |
| 5,977,554 A | 11/1999 | Smith et al. | 250/493.1 |
| 6,160,263 A | 12/2000 | Smith et al. | 250/493.1 |

OTHER PUBLICATIONS

M.H. Holzssscheiter, X. Feng, T. Goldman, N.S.P. King, R.A. Lewis, M.M. Nieto and G.A. Smith, Are antiprotons forever?, Physics Letters A 214 (1996) 279–284, Elsevier Science B.V., The Netherlands.

D.J. Wineland and H.G. Dehmelt, Principles of the stored ion calorimeter*, Journal of Applied Physics, vol. 46, No. 2, Feb. 1975, pp. 919–930.

R.A. Lewis, G.A. Smith and S.D. Howe, Antiproton portable traps and medical applications*, Hyperfine Interactions 109 (1997) 155–164, J.C. Baltzer AG, Science Publishers.

Malcolm W. Browne, Physicists Succeed in Creating Atom Out of Antimatter, The New York Times International, Fri. Jan. 5, 1996.

Harold McFarlane et al., Transactions of the American Nuclear Society, vol. 74, pp. 136–137, Jun. 16–20, 1996, American Nuclear Society, Incorporated, La Grange Park, Illinois 60526.

(List continued on next page.)

*Primary Examiner*—Kiet T. Nguyen
(74) *Attorney, Agent, or Firm*—Duane Morris LLP

(57) ABSTRACT

The invention provides a container for transporting antiprotons including a dewar having an evacuated cavity and a cryogenically cold wall. A plurality of thermally conductive supports are disposed in thermal connection with the cold wall and extend into the cavity. An antiproton trap is mounted on-the extending supports within the cavity. A sealable cavity access port selectively provides access to the cavity for selective introduction into and removal from the cavity of the antiprotons. The container is capable of confining and storing antiprotons while they are transported via conventional terrestrial or airborne methods to a location distant from their creation.

18 Claims, 13 Drawing Sheets

OTHER PUBLICATIONS

Jerome M. Rose, Capturing Antimatter, Compressed Air, Jun. 1997, pp. 50–57.
Malcolm W. Browne, Physicist Strive to Create Atoms of Antihydrogen From Antimatter, The New York Times, Science Times, Tuesday, Nov. 15, 1994.
Andrew Watson, Trapped antimatter holds on to life, New Scientist, Jan. 13, 1996, p. 18.
Stanley K. Borowski and Brice N. Cassenti, Nuclear thermal propulsion, Aerospace America, Dec. 1995, p. 49.
David Graham, Have Antimatter, Will Travel, Technology Review, Trends, Jul. 14, 1994, pp. 14–15.
Portable Source Produces PET Radioisotopes "On Demand", Radiology & Imaging Letter, Nov. 15, 1995, vol. 15, No. 20.
Justin Warner, A churnful of antiprotons, please, New Scientist, Sep. 17, 1994, p. 20.
Valerie Manns, Anti–matter research really matters, Centre Daily Times, Jul. 7, 1997.
Frank D. Roylance, The real world of antimatter, Baltimore Sun, Sunday, Jun. 22, 1997, p. 2A.
Fred Guterl, A Small Problem of Propulsion, Discover, Oct. 1995, pp. 102–108.

* cited by examiner

CONTAINER FOR TRANSPORTING ANTIPROTONS AND REACTION TRAP

This application is a continuation-in-part of application Ser. No. 09/405,774, filed Sep. 27, 1999, now U.S. Pat. No. 6,160,263, which is itself a continuation of application Ser. No. 09/046,064, file Mar. 23, 1998, and now issued as U.S. Pat. No. 5,977,554.

FIELD OF THE INVENTION

The present invention generally relates to the confinement and storage of highly transitory and reactive materials, and more particularly to the confinement and storage of antimatter.

BACKGROUND OF THE INVENTION

Antimatter consists of subatomic particles that are structurally identical to subatomic particles of matter, but have opposite fundamental properties. For example, positrons (antielectrons) possess the same quantum characteristics as electrons (spin, angular momentum, mass, etc.) but are positively charged. Antiprotons possess the same quantum characteristics as protons, but are negatively charged. When an antiparticle, such as an antiproton, collides with its corresponding matter particle (in this case a proton) they annihilate each other, converting their mass into energy. Antimatter annihilates so readily that it only exists on earth when it is artificially generated in high-energy particle accelerators. Elaborate means have been developed for storing antimatter on earth once it has been created. Often these means have included large, fixed machines such as the low-energy antiproton ring (LEAR) at CERN, in Switzerland, or the Antiproton Accumulator at Fermilab in the United States. Devices such as LEAR are extraordinarily complex, and relatively expensive to build, maintain, and operate.

Apparatus and methods for the production, containment and manipulation of antimatter, on a commercial scale, are also known in the art. For example, U.S. Pat. No. 4,867,939, issued to Deutch on Sep. 19, 1989, provides a process for producing antihydrogen which includes providing low-energy antiprotons and positronium (a bound electron-positron atomic system) within an interaction volume. Thermalized positrons are directed by electrostatic lenses to a positronium converter, positioned adjacent to a low-energy (less than 50 kiloelectronvolts or 50 keV) circulating antiproton beam confined within an ion trap. Collisions between antiprotons and ortho-positronium atoms generate antihydrogen, a stable antimatter species.

Deutch proposes use of an ion trap which can be either a high-vacuum penning trap or a radio frequency quadrupole (RFQ) trap, with a racetrack design RFQ trap being preferred. Deutch provides non-magnetic confinement of the antimatter species by use of dynamic radio frequency electric fields. Deutch does not disclose any method or apparatus for confining antiprotons in a manner appropriate for their storage and transportation to a location distant from their creation.

In U.S. Pat. No. 5,206,506, issued to Kirchner on Apr. 27, 1993, an ion processing unit is disclosed including a series of M perforated electrode sheets, driving electronics, and a central processing unit that allows formation, shaping and translation of multiple effective potential wells. Ions, trapped within a given effective potential well, can be isolated, transferred, cooled or heated, separated, and combined. Kirchner discloses the combination of many electrode sheets, each having N multiple perforations, to create any number of parallel ion processing channels. The ion processing unit provides an N by M, massively-parallel, ion processing system. Thus, Kirchner provides a variant of the well known non-magnetic radio frequency quadrupole ion trap that is often used for the identification and measurement of ion species. Kirchner's multiple electrode structures (FIGS. 1 and 2) appear to serve as an ion source and confinement barrier.

Kirchner suggests that his apparatus is well suited for storing antimatter. More particularly, Kirchner suggests that as antimatter is produced, groups of positronium or other charged antimatter can be introduced into each processing channel and held confined to an individually effective potential well. Kirchner also suggests that large amounts of antimatter could thereby be "clocked-in" just as an electronic buffer "clocks-in" a digital signal. It would appear that the adaptive fields created by Kirchner's device might allow for the long-term storage of antimatter in a kind of electrode sponge. However, in suggesting the application of his device to antimatter confinement, Kirchner fails to disclose many essential aspects of such a device. For one thing, he makes no mention of vacuum requirements, which are essential to long-term confinement, storage, and transportation of antimatter. For another thing, Kirchner fails to provide any effective means for introducing antimatter, e.g., antiprotons, into his device or for effectively removing them from his device once they have been "clocked" through.

Antimatter could have numerous beneficial commercial/industrial and transportation related applications if it could be effectively stored and transported. For example, antiprotons may be usefully employed to detect impurities in manufactured materials, e.g., fan blades for turbines. Plasma created by the interaction of antimatter with matter could be employed as a propellant for terrestrial aircraft or, spacecraft for planetary or interstellar travel. Concentrated beams of antiprotons may be directed onto diseased tissue, e.g., cancer cells, to deliver concentrated radiation to those cells thereby destroying them, but without significantly affecting surrounding healthy tissue.

Commercial and industrial applications of antiprotons have been hampered by the fact that such activities must be undertaken at, or very close to, the place where antiprotons are generated, e.g., a high energy physics laboratory operating a synchrotron or the like. This is due to the very short life expectancy of an antiproton. As a result, antiprotons are not often used in commercial and industrial settings, due to the extraordinary requirements associated with the operation of a synchrotron of the type used to generate antiprotons in significant quantities.

SUMMARY OF THE INVENTION

In its broadest aspects, the invention provides a reaction trap including a dewar having an evacuated cavity and a cryogenic cold wall and an antiproton trap mounted within the dewar and thermally interconnected with the cold wall. The antiproton trap defines an antiproton penning region and a reaction region. A reactant insertion port; a reactant exit port and a passageway extending therebetween are defined through the dewar and the antiproton trap. Preferably, the reactant exit port is positioned adjacent to the reaction region of the antiproton trap. A sealable access port selectively provides access to the antiproton trap for selective introduction of antiprotons into the antiproton penning region. A sealable exit port selectively provides egress from the antiproton trap for selective discharge of reaction by-products formed within the reaction region.

Another inventive aspect of the present invention is the provision of a system for controlled interaction of matter and antimatter that includes a storage container for transporting antiprotons comprising a first dewar having an evacuated cavity and a cryogenic cold wall and a plurality of thermally conductive supports in thermal connection with the cold wall and extending into the cavity. A first antiproton trap is mounted on the extending supports within the cavity and a sealable cavity access port selectively provides access to the cavity for selective introduction into and removal from the cavity of the antiprotons. The system also includes a reaction trap including a second dewar having an evacuated cavity and a cryogenic cold wall. A second antiproton trap is mounted within the dewar and thermally interconnected with the cold wall. The antiproton trap defines an antiproton penning region and a reaction region. A reactant insertion port, a reactant exit port and a passageway extending therebetween are defined through the dewar and the antiproton trap. Preferably, the reactant exit port is positioned adjacent to the reaction region of the antiproton trap. A sealable access port selectively provides access from the sealable cavity access port of the first antiproton trap to the second antiproton trap for selective introduction of antiprotons into the antiproton penning region. A sealable exit port selectively provides egress from the second antiproton trap for selective discharge of reaction by-products formed within the reaction region.

In its broadest aspects, the present invention also comprises a method for controlled interaction between antimatter and matter. First and second antiproton confinement regions are provided and maintained at an ultra-low pressure and cryogenic temperature. A controllable magnetic field and controllable electric fields are established in each of the antiproton confinement regions. The electric fields are controlled so as to urge antiprotons from the first confinement region into the second antiproton confinement region. The electric fields are then modified so as to retain antiprotons in the second antiproton confinement region in dual nested electric potential wells. A reactant material is introduced into a region of space defined between the dual nested electric potential wells and the electric fields are modified so as to urge the antiprotons in the second antiproton confinement region toward the reactant material so as to controllably annihilate the reactant material.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
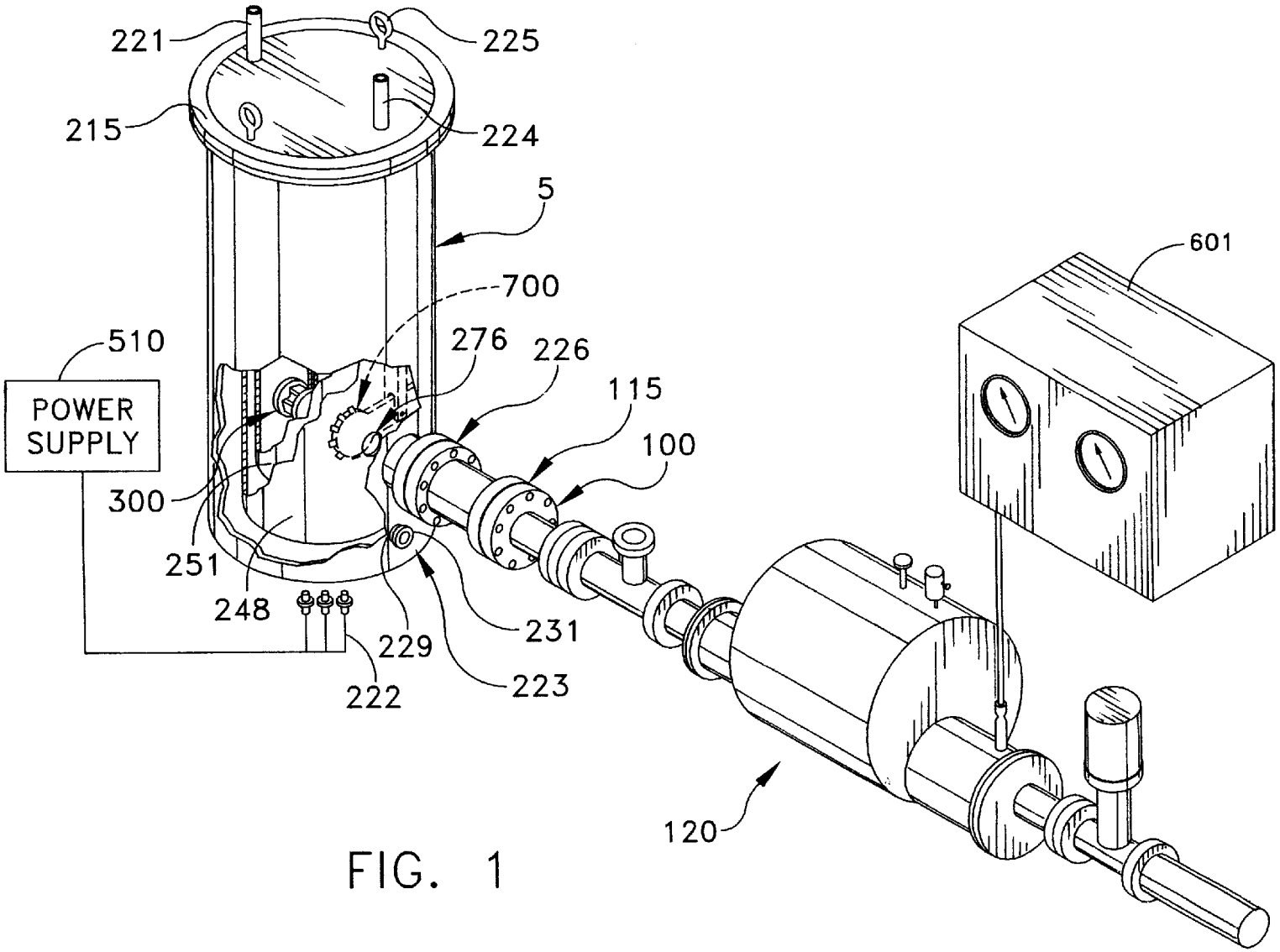
FIG. 1 is a perspective view, partially broken away, of a storage container for transporting antiprotons formed in accordance with one embodiment of the present invention and having an antiproton injection/ejection snout assembly attached to a lower portion of the storage container and a reaction trap attached to an end of the snout assembly.
Figure 2:
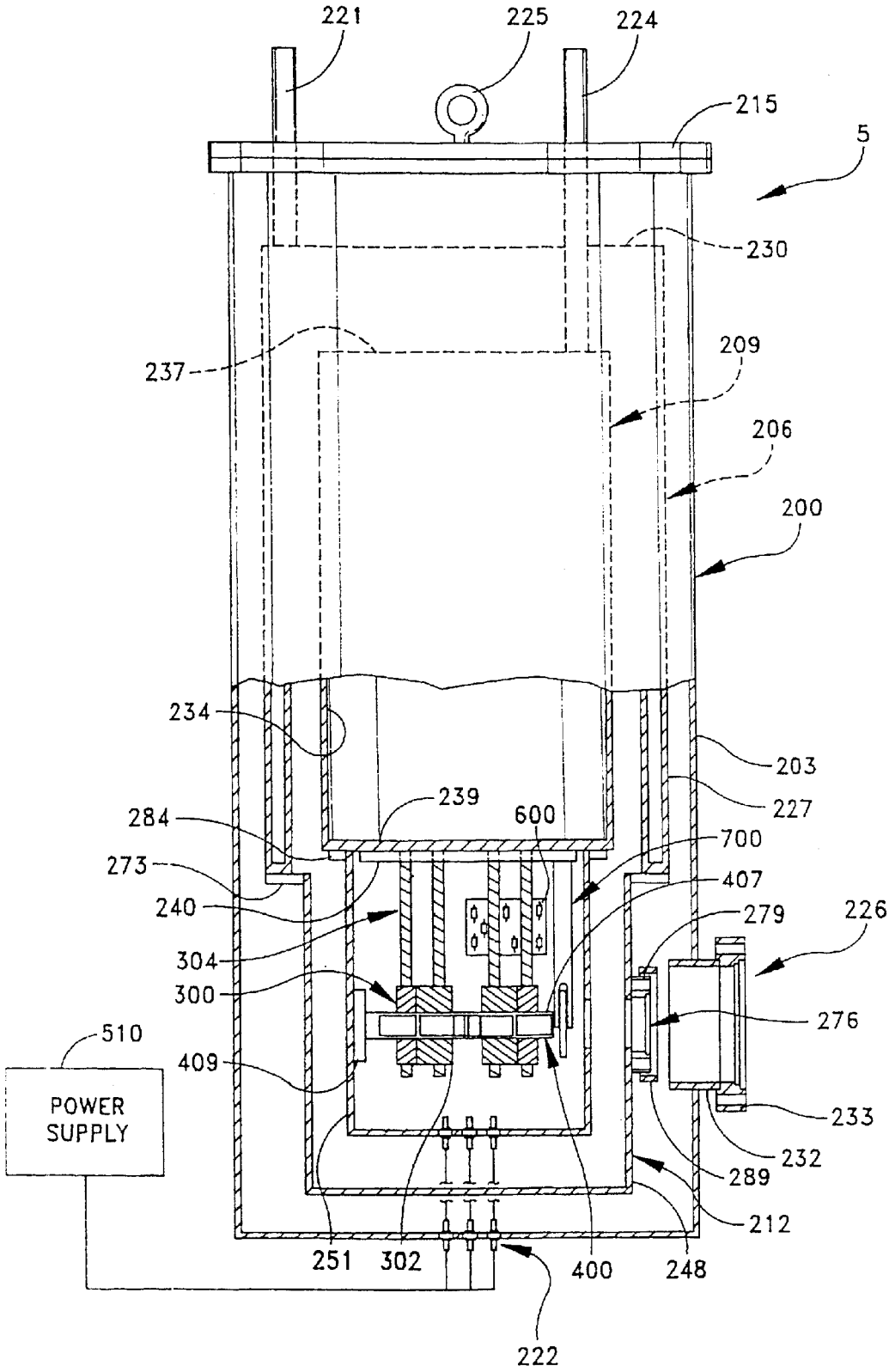
FIG. 2 is a front elevational view, in cross-section, of the storage container shown in FIG. 1, as taken along lines 2–2, and with the snout assembly removed.
Figure 3:
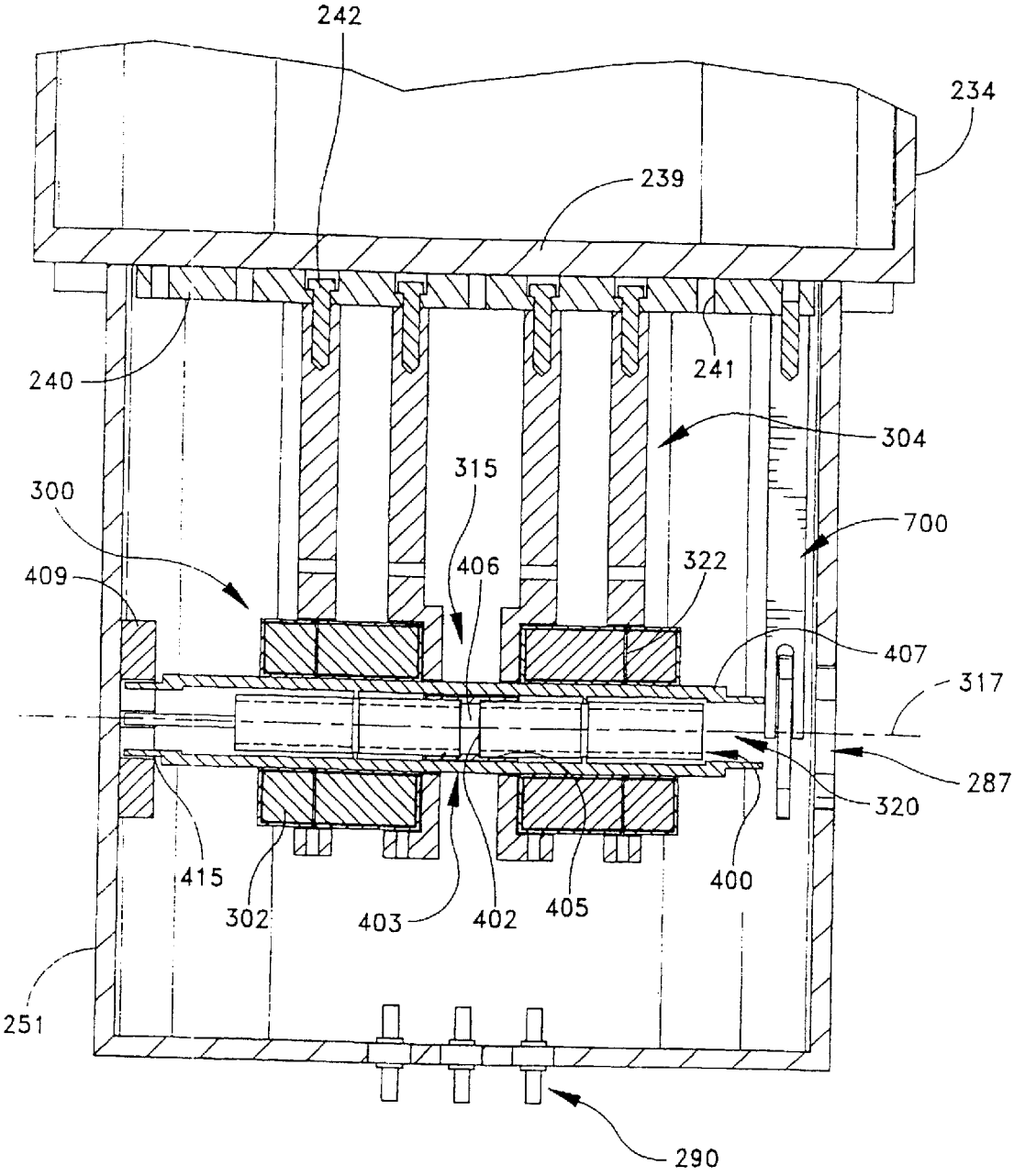
FIG. 3 is a cross-sectional view of an inner portion of the tail assembly that has been broken-away from the storage container of FIG. 1 for clarity of illustration.

FIG. 1 shows an antiproton storage container 5 for confining, storing and transporting antiprotons, a snout assembly 100 for injecting/ejecting antiprotons into and out of storage container 5, and a reaction trap 120 for creation of plasma through the controlled interaction of antiprotons with matter. Referring to FIGS. 1, 2 and 3, antiproton storage container 5 comprises a dewar assembly 200, a magnet assembly 300, an electrode assembly 400, a detector 600 and a shutter assembly 700.

Dewar assembly 200 includes an outer vacuum shell 203, at least two coolant reservoirs 206 and 209, and a tail assembly 212 that are arranged to withstand and maintain ultra-low, "cryogenic" temperatures, i.e., temperatures of no more than 100 degrees above absolute zero, as measured in degrees Kelvin. Outer vacuum shell 203 comprises a blind cylindrical shape having a top plate 215 that is adapted to releasably hermetically seal the open top end of vacuum shell 203. Vacuum shell 203 is typically formed from stainless steel or the like. A first tubular fill line 221 and a second tubular fill line 224 extend through top plate 215. A pair of lifting eyelets 225 project outwardly from top plate 215 and are adapted for engagement with lifting hooks or lines so that antiproton storage container 5 may be moved from place to place, e.g. from a synchrotron site to the bed of a truck or airplane.

Vacuum shell 203 also comprises high voltage ports 222, a vacuum feed port 223, and a snout interface port 226 (FIG. 1). High voltage ports 222 are adapted to provide electrical access to the interior of antiproton storage container 5, and may comprise any of the well known electrical interconnection devices that are suitable for use with ultra-low vacuum systems. Vacuum feed port 223 is defined by an outwardly projecting, tubular cylinder 229 having a radially-outwardly projecting annular coupling flange 231. Snout interface port 226 is defined by an outwardly projecting, tubular cylinder 232 having a radially-outwardly projecting annular coupling flange 233.

Figure 4:
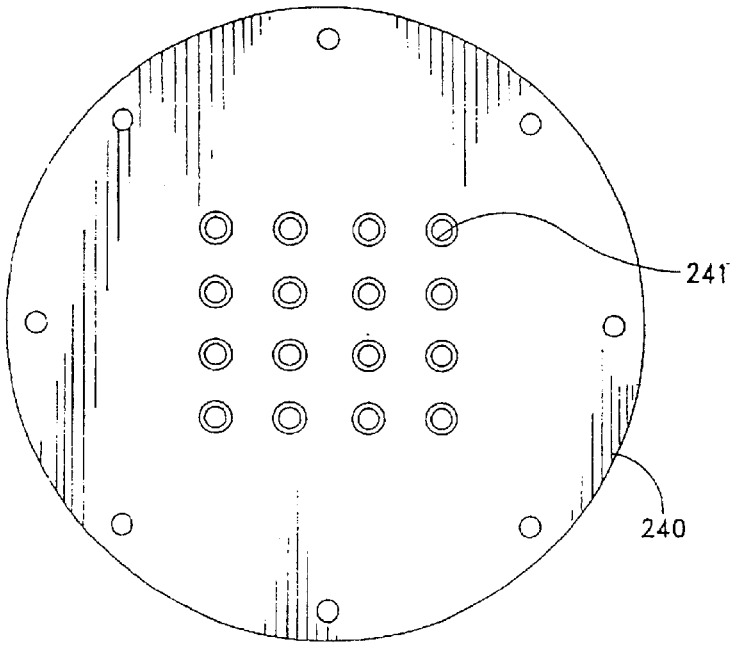
FIG. 4 is a front elevational view of a base plate used in connection with a second reservoir in the storage container shown in FIG. 1.

Referring to FIG. 2, first reservoir 206 comprises a blind, hollow cylindrical shape defined by a hollow cylindrical wall 227 that is adapted to contain a first coolant, e.g., liquid nitrogen. First reservoir 206 includes a closed top end 230 and an open bottom end, and has an outer diameter sized so that it may be received within the interior of vacuum shell 203 and an inner diameter sized so that second reservoir 209 may be disposed within. First fill line 221 is disposed in fluid communication with the interior of hollow cylindrical wall 227 to provide an opening for introducing the first coolant therein. Second reservoir 209 comprises cylindrical wall 234, a top 237 and a bottom 239 that together define a hollow interior cavity within second reservoir 209. Second fill line 224 is disposed in fluid communication with the interior cavity of second reservoir 209 to provide an opening for introducing a second coolant, e.g., liquid helium, into second reservoir 209. Second reservoir 209 is sized so as to be coaxially disposed within first reservoir 206. A base plate 240 that is fastenable to bottom 239 (e.g., by bolts, welds, or other means) acts as a cold wall interface with magnet assembly 300 and electrode assembly 400, as will hereinafter be disclosed in further detail. A plurality of bores 241 extend through base plate 240 (FIGS. 3, 4 and 9) and are adapted to receive fasteners, e.g., threaded bolts 242 or the like.

Referring to FIGS. 1, 2 and 3, tail assembly 212 completes dewar assembly 200, and includes a first tail 248, and a second tail 251. First tail 248 comprises a blind, hollow cylinder having a similar diameter to first reservoir 206. An annular flange 273 projects radially-outwardly from the edge of the open end of first tail 248. A beam port 276 is disposed in the cylindrical wall of first tail 248. Beam port 276 is defined by an outwardly projecting, tubular cylinder 279 having a radially-outwardly projecting annular coupling flange 281 disposed at its free end. Typically, the aperture of beam port 276 is approximately 3.2 cm in diameter.

Second tail 251 comprises a blind, hollow cylinder having a similar diameter to second reservoir 209. An annular flange 284 projects radially-outwardly from the edge of the open end of second tail 251. A beam port 287 (FIG. 3) is defined by a through-bore disposed in the cylindrical wall of second tail 251. A plurality of vacuum feed-through ports 290 extend through the closed end of second tail 251.

Figure 5:
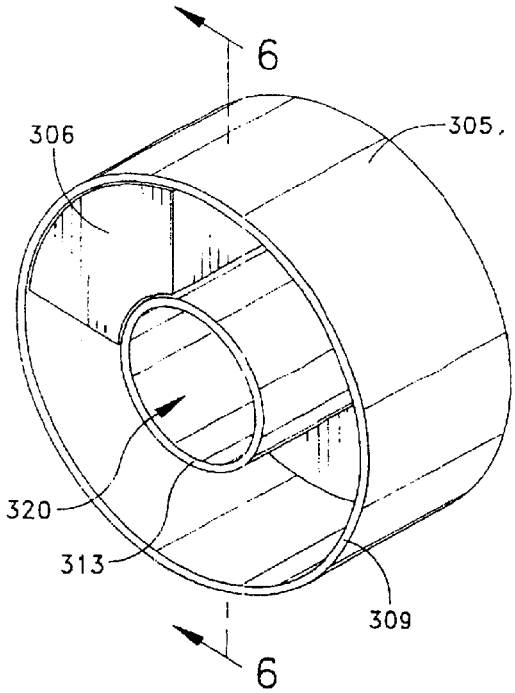
FIG. 5 is a perspective view of an individual magnet jacket containing one segment-shaped magnetic insert.
Figure 6:
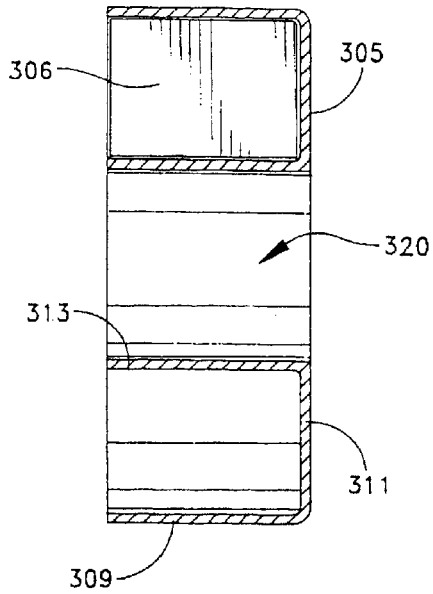
FIG. 6 is a cross sectional view of the magnet jacket shown in FIG. 5.
Figure 7:
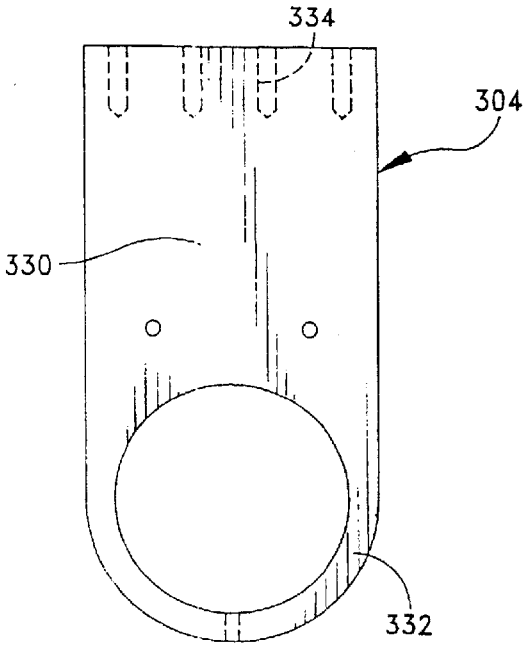
FIG. 7 is a front elevational view of a magnet support.
Figure 8:
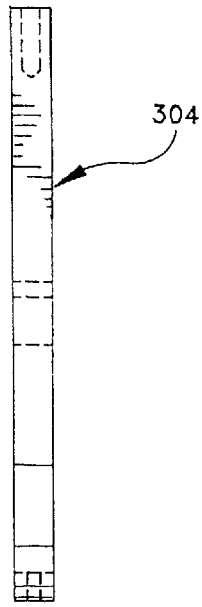
FIG. 8 is a side elevational view of the magnet support of FIG. 7.

Referring to FIGS. 2–16, magnet assembly 300 and electrode assembly 400 together form the functional elements of an antiproton trap. Magnet assembly 300 (FIGS. 2 and 3) typically comprises four magnets 302 and four magnet supports 304. More particularly, each magnet 302 comprises a substantially torroidally shaped jacket 305 (FIGS. 5 and 6) housing a plurality of segment-shaped magnetic inserts 306. Torroidally shaped jacket 305 is formed so as to define an open ended recess 307 between an outer wall 309, a bottom wall 311, and a centrally disposed cylindrical tube 313 that projects upwardly from the inner surface of bottom wall 311. (FIGS. 5 and 6). Each torroidally shaped jacket 305 is sized and shaped so that, when assembled to other jackets, they may be arranged into pairs of magnets comprising an inner and an outer magnet in each pair, with a gap 315 disposed between the inner magnets of the two pairs (FIG. 3). In this arrangement, each cylindrical tube 313 of each magnet 302 is coaxially aligned along a common longitudinal axis 317 to form an open ended passageway 320 through magnet assembly 300, a portion of which is shown as a part of FIGS. 5 and 6.

Plurality of segment-shaped magnetic inserts 306 are preferably formed from sintered powdered metal alloys, such as SmCo, NdFeB or the like, and typically have the properties disclosed in the following table:

| | Density g/cm$^3$ | Curie-temp. ° C. | Spec. electr. resistance Ωmm$^2$/m | Spec. heat J/(kg · K) | Thermal Conductivity W/(m · K) | Coefficient of thermal expansion 20–100° C. ∥ c $10^{-4}$/K | Coefficient of thermal expansion 20–100° C. ⊥ c $10^{-8}$/K | Young's modulus kN/mm$^2$ | Banding strength N/mm$^2$ | Compressive strength N/mm$^2$ | Vickers hardness HV | Stress crack resistance $K_c$ N/mm$^{3/2}$ |
|---|---|---|---|---|---|---|---|---|---|---|---|---|
| NdFeB | 7.5 | ca. 310 | 1.4–1.6 | ca. 440 | ca. 9 | 5 | −1 | 150 | ca. 270 | ca. 1050 | ca. 570 | 70–90 |
| $Sm_2Co_{17}$ | 8.4 | ca. 800 | 0.75–0.85 | ca. 390 | ca. 12 | 10 | 12 | 150 | 90–150 | ca. 850 | ca. 640 | 40–50 |
| Sm $Co_5$ | 8.4 | ca. 720 | 0.5–0.6 | ca. 370 | ca. 10 | 7 | 13 | 110 | ca. 120 | ca. 1000 | ca. 550 | 50–70 |

Electromagnets may be substituted for permanent magnets 302 in the present invention, although they are not a preferred means for providing the necessary magnetic fields.

Preferably, the two inner magnets 302 are transversely (i.e., radially) polarized and are positioned adjacent to gap 315. Of these two inner magnets, one is polarized so as to have a net radial field component directed radially-inwardly and one is polarized so as to have a net radial field component directed radially-outwardly, relative to longitudinal axis 317 of open ended passageway 320. The outer two magnets are longitudinally polarized to both have a net longitudinal field component directed inwardly, toward gap 315. Axial magnetic fields on the order of about 3500 to 4500 Gauss are typically found in the region defined by gap 315. Washer seals and spacers 322 are positioned between each magnet 302 during assembly, and are typically formed from stainless steel or the like.

Figure 9:
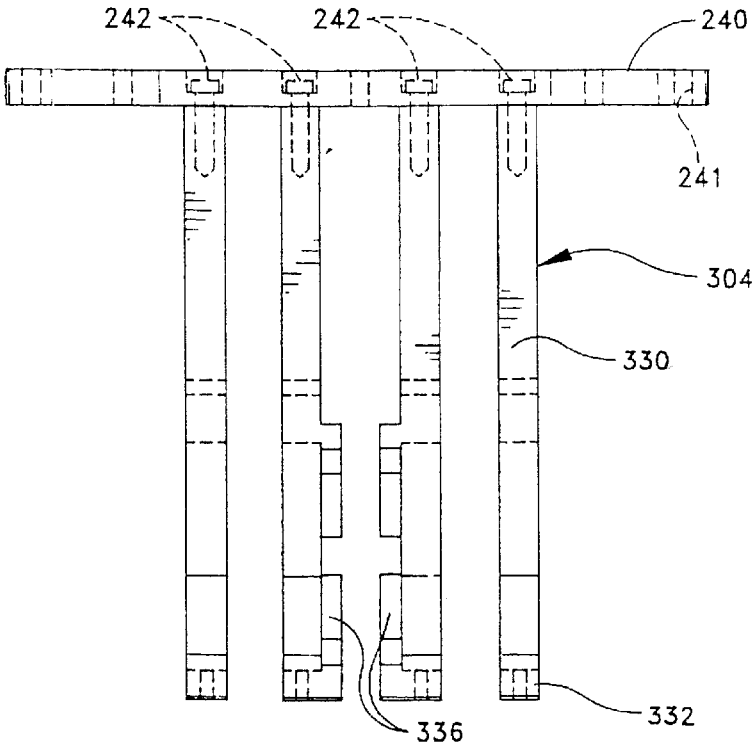
FIG. 9 is a side elevational view of a plurality of magnet supports mounted to the base plate of FIG. 4, and showing inner magnet supports having a plurality of circumferentially arranged projections provided about the yoke.
Figure 10:
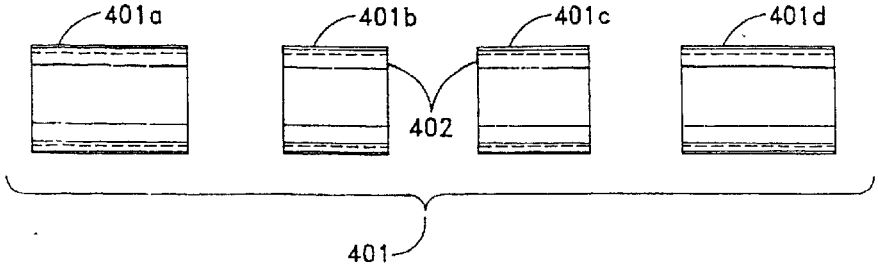
FIG. 10 is a side elevational view of an electrode assembly.

Referring to FIGS. 3 and 7–9, magnet supports 304 each include a cold finger 330 and a yoke 332. Cold fingers 330 comprise a planar plate of highly thermally conductive material, e.g., copper or an alloy thereof. A plurality of blind bores 334 are arranged at one end of each cold finger 330. One yoke 332 is disposed at an end of each magnet support 304. The internal diameter of each yoke 332 is sized and shaped to receive at least one of torroidal magnets 302. At least two inner yokes also include a plurality of circumferentially arranged projections 336 that provide support for the inner magnets 302 (FIG. 9). During assembly of antiproton storage container 5, four cold fingers 330 are fastened to the underside of base plate 240 of second reservoir 209 in generally parallel relation to one another and substantially perpendicular relation to base plate 240 (FIGS. 1–3). As a result of this arrangement, cold fingers 330 and base plate 240 are disposed in intimate thermal communication with one another.

Referring to FIGS. 3 and 10–13, electrode subassembly 400 includes electrodes 401 and spacer assembly 403. In one embodiment, four electrodes, 401*a*, 401*b*, 401*c*, and 401*d* (401*a–d*) are utilized. Electrodes 401*a–d* comprise a plurality of discrete, coaxially aligned cylindrical tubes sized so as to fit loosely within open ended passageway 320 of magnets 302. Electrodes 401 are typically formed from a highly conductive metal, such as copper or its alloys. Gap 315 is further defined by the spaced-apart edges 402 of inner electrodes 401*b*, 401*c* (FIG. 3). The portion of gap 315 disposed between inner electrodes 401*b* and 401*c* defines an antiproton confinement region in which an effective electrical potential well may be formed which is suitable for penning antiprotons, as will hereinafter be disclosed in further detail. Electrodes 401 are individually interconnected to a source of high voltage electrical potential (shown generally at reference numeral 510 in FIG. 1) via conventional electrical conductors (not shown), so that each electrode may be independently energized as required during injection, storage, transport, and ejection of the antiprotons, as will hereinafter be disclosed in further detail.

Figure 11:
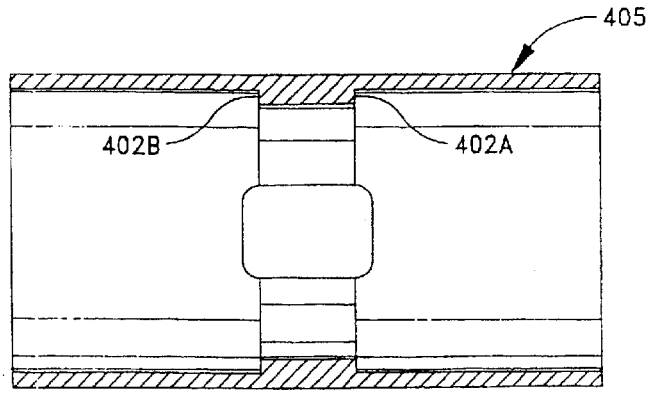
FIG. 11 is a cross-sectional view of a magnet mount.
Figure 12:
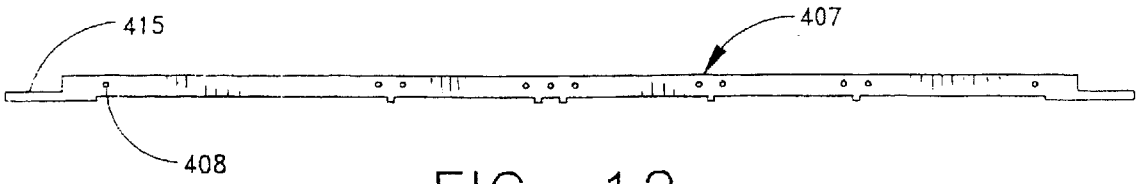
FIG. 12 is a side elevational view of a dielectric spacer bar.
Figure 13:
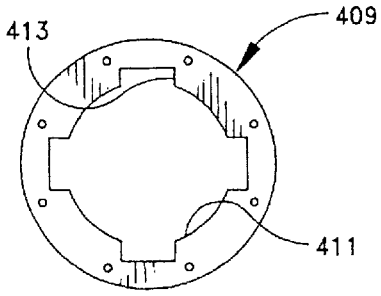
FIG. 13 is a front elevational view of an end ring.

Referring to FIGS. 3 and 11–13, spacer assembly 403 includes magnet mount 405, spacer bars 407, and end rings 409. More particularly, magnet mount 405 comprises a cylindrical tube sized to fit within open ended passageway 320 of magnet assembly 300, and disposed across gap 315. Magnet mount 405 has a diameter that is sized to receive portions of innermost electrodes 401*b* and 401*c*, as shown in FIGS. 3 and 11. A pair of shoulders 402A and 402B are formed in the surface of the internal wall of magnet mount 405, and are adapted to engage edges 402 of electrodes 401*b* and 401*c* so as to create a gap 406 therebetween. Magnet mount 405 is preferably formed from a non-magnetic material, e.g., a polymer such as Macor® brand, or aluminum or the like. Spacer bars 407 comprise elongate spars having a length in-excess of the length of open ended passageway 320. Spacer bars 407 are preferably formed from non-magnetic and electrically non-conductive materials. A plurality of through bores 408 are defined along the length of each spacer bar 407, and are adapted to receive fasteners, e.g., screws, bolts, etc. Spacer bars 407 are fastened to the outer surfaces of magnet mount 405 to form a cradle that is adapted for receiving electrodes 401*a–d* and to prevent electrical contact between magnets 302 and electrodes 401. End ring 409 (FIGS. 2, 3, and 13) comprises a cruciform-shaped central opening 411 having notches 413 that are adapted to receive ends 415 of spacer bars 407 to complete the electrode cradle.

Figure 14:
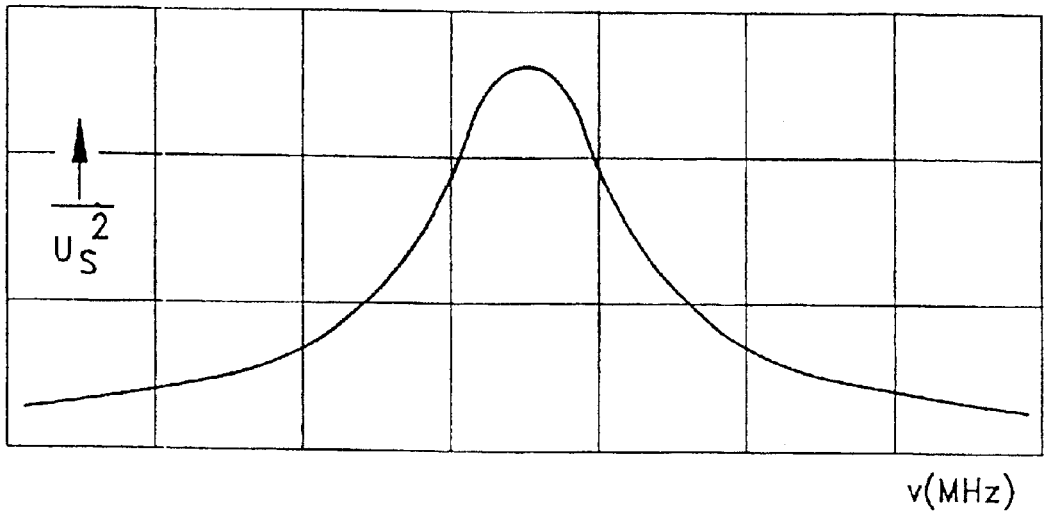
FIG. 14 is a graphical representation of a typical plot of the signal voltage versus noise frequency spectrum for the antiproton confinement region of the present invention without antiprotons resident therein.
Figure 15:
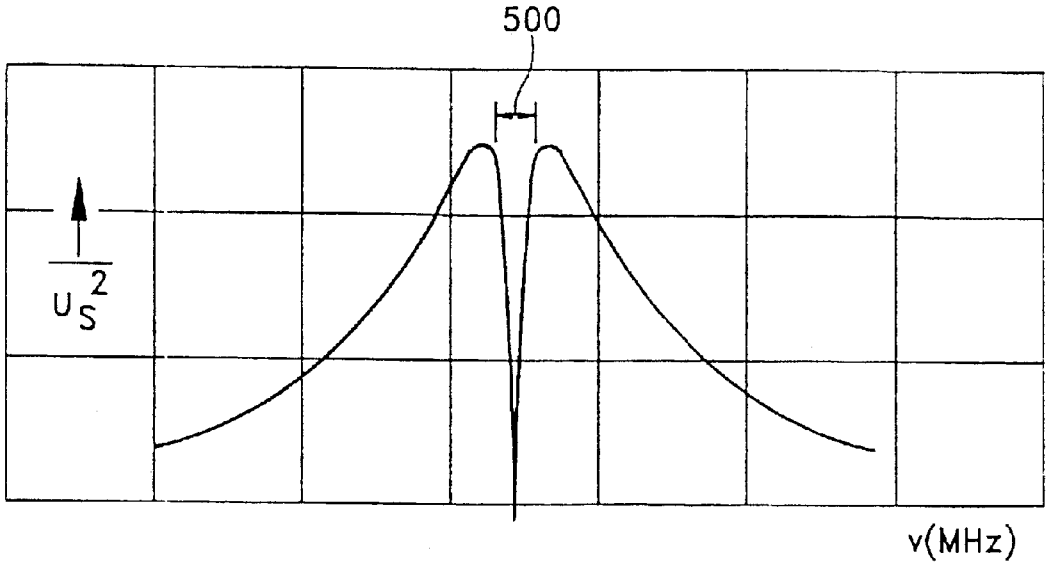
FIG. 15 is a graphical representation of a plot of signal voltage versus noise frequency spectrum, similar to that shown in FIG. 14, but with the noise from the center of the spectrum shunted by the effective impedance of antiprotons resident within the antiproton confinement region of the invention.
Figure 16:
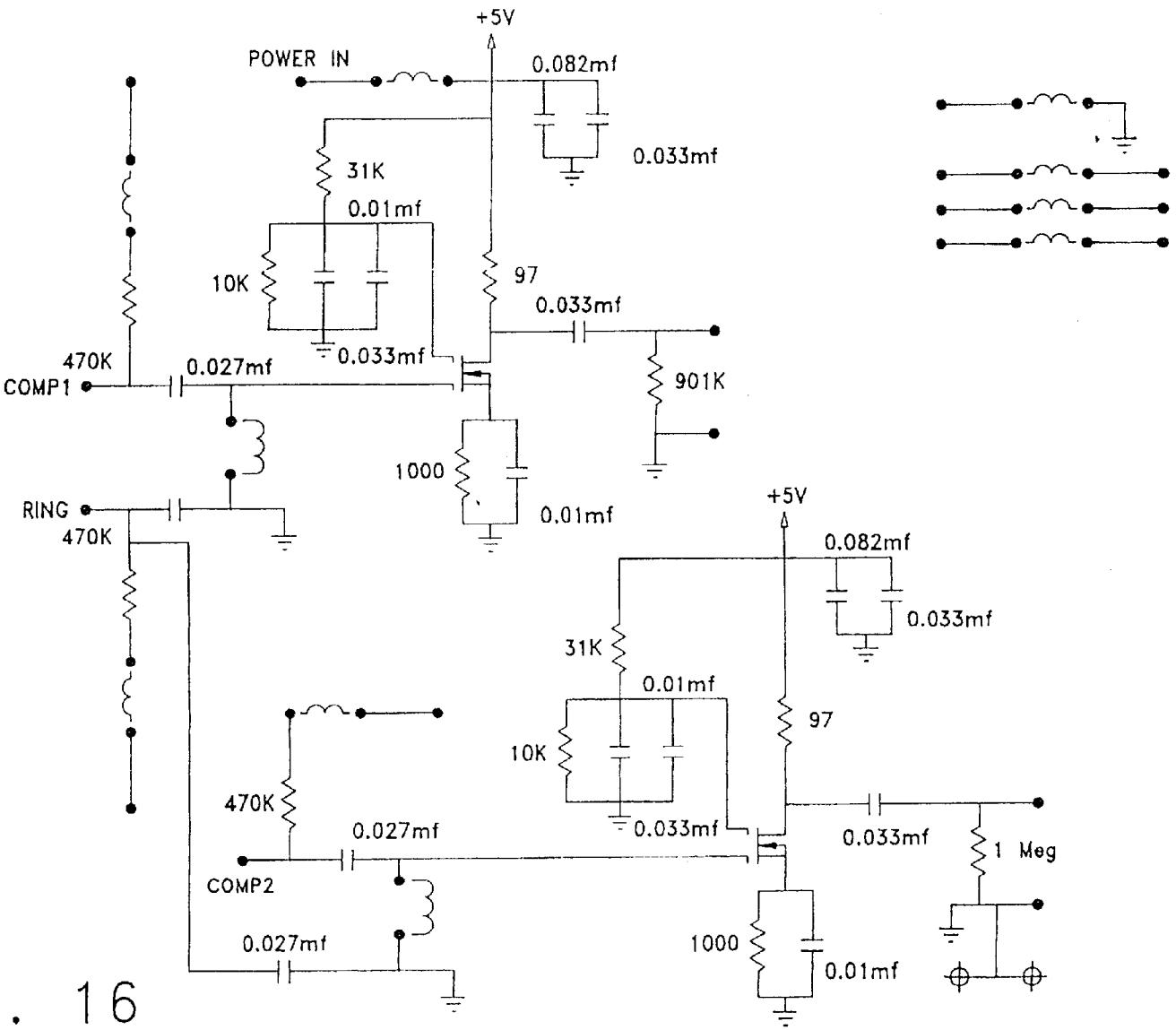
FIG. 16 is a schematic representation of an RLC circuit used in connection with detecting antiprotons trapped in the storage container of the present invention.

Referring now to FIGS. 14–16, antiprotons may be detected within the antiproton trap formed by magnet assembly 300 and electrode assembly 400 by observation of changes in the noise spectrum emanating from the penning region defined within gap 315. Briefly, without antiprotons present in the penning region of the trap, the noise spectrum will exhibit a Lorentzian shape (see FIG. 14) when the frequency of the noise is plotted as a function of the average of the square of the signal voltage ($u_s^2=4\ kT_0R\Delta v$ where k=Boltzman's constant, $T_0$ is absolute temperature in degrees Kelvin, R is the input resistance and $\Delta v$ is the spectral width). This effect is well known, and is often referred to as Johnson noise. Antiprotons present within the penning region of the trap cause the noise from the center of the spectrum (FIG. 15) to be shunted by their effective impedance. The emission frequency of the antiprotons, where their effective impedance shunts the spectrum, is approximately 780 kHz. The shunting line width (indicated as reference numeral 500 in FIG. 15) may also be used to determine the number of antiprotons in the penning region of antiproton storage container 5.

This effect and its use as a technique for the measurement of quantities of matter, e.g., electrons, is fully described and understandable to those skilled in the art in an article entitled "Principles of the Stored Ion Calorimeter" by D. J. Wineland and H. G. Dehmelt, Department of Physics, University of Washington, Seattle, Wash., U.S.A.; published in the Journal of Applied Physics, Vol. 46, No. 2, pages 919 to 930, February 1975, which article is hereby incorporated herein by reference.

Referring now to FIGS. 2 and 16, a detector 600 is disposed on the exterior of magnet assembly 300, via mounting supports, that are adapted to secure detector 600 to the antiproton trap. Detector 600 comprise an electric board (schematically illustrated in FIG. 16) that comprises receiver means, such as a tuned resonant RLC circuit, that are tuned for detection of the radio frequency emissions of the antiprotons trapped in the penning region formed within gap 315 (about 780 kHz). In this way, the oscillations of the antiprotons are detected within the antiproton trap after their injection, with their number being determined by the method disclosed hereinabove. It will be understood that a similar technique may be utilized in connection with reaction trap 120.

Figure 17:
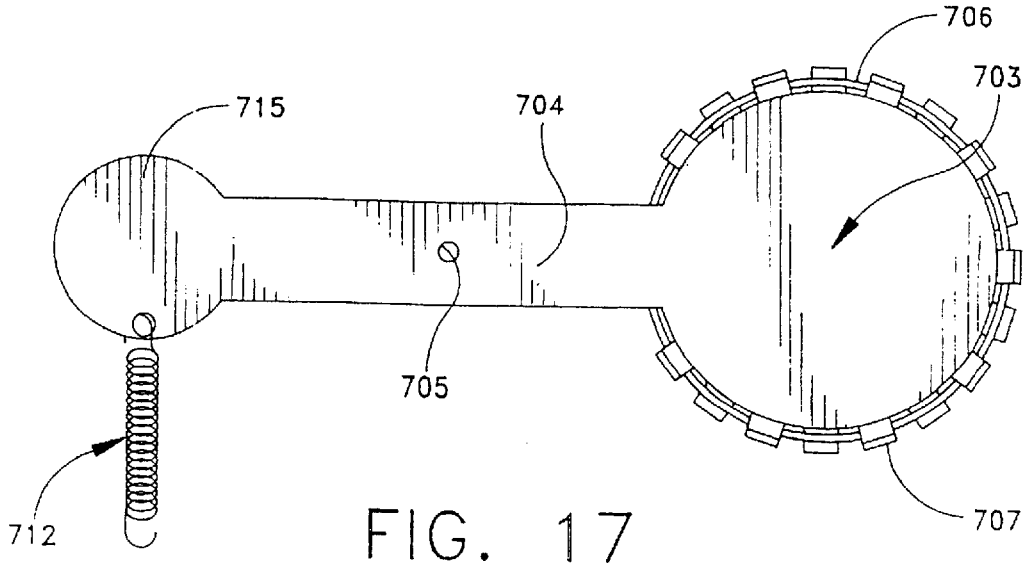
FIG. 17 is a front elevational view of a shutter, including a return spring.
Figure 18:
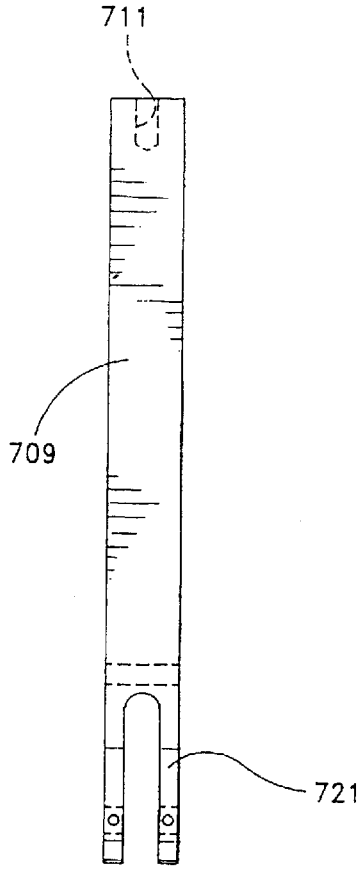
FIG. 18 is a front elevational view of a shutter support.

Referring to FIGS. 1 and 17–18, shutter mechanism 700 is adapted to substantially cover beam port 287 to prevent stray atoms from wandering into the antiproton trap from the evacuated cavities formed by second tail 251, first tail assembly 248 and snout assembly 100. Shutter mechanism 700 is fastened to base plate 240 so that it may be positioned between beam port 287 and the entrance to open ended passageway 320. From this position, it may be pivoted into and out of position in front of beam port 287. Shutter mechanism 700 comprises a shutter 703, a coiled conductor 706, a shutter support 709, and a return spring 712. More particularly, shutter 703 comprises a ring or disk of either a polymer or metal material and a shaft portion 704 having a pivot hole 705 defined midway along its length. Coiled conductor 706 is wound onto the circumference of the disk portion of shutter 703 and is held in place by tabs 707. Coiled conductor 706 is electrically interconnected to a selectively energizable source of electrical potential (shown generally at reference numeral 510 in FIG. 1). A counter weight 715 is disposed at one end of shaft portion 704. Shutter support 709 includes a pivot yoke 721 through which a pivot pin pivotally maintains shutter 703 in position. A blind bore 711 is defined at the end of shutter support 709, and is adapted to receive a fastener, such as bolt 242. Return spring 712 is fastened between a portion of shutter support 709 and counter weight 715. Coiled conductor 706 is adapted to be energized at a predetermined current so as to cause shutter 703 to pivot about pivot hole 705 when in the presence of a magnetic field, such as the fringe field of the trap magnets 302. Return spring 712 helps to bias shutter 703 back to its "at-rest" position (in front of port 287) when coil 706 is not energized. In this way. shutter 703 acts as a baffle between the cryogenic vacuum, near to magnet assembly 300, and the relatively warm vacuum region of the outer tails and injection/ejection snout assembly 100. Of course other means for separating the evacuated regions of antiproton storage container 5 may be used without departing from the scope of the invention. For example, and not by way of limitation, an iris mechanism, a series of movable slats, or a movable diaphragm, etc., may all be used to selectively obstruct the entrance to the antiproton trap.

Figure 19:
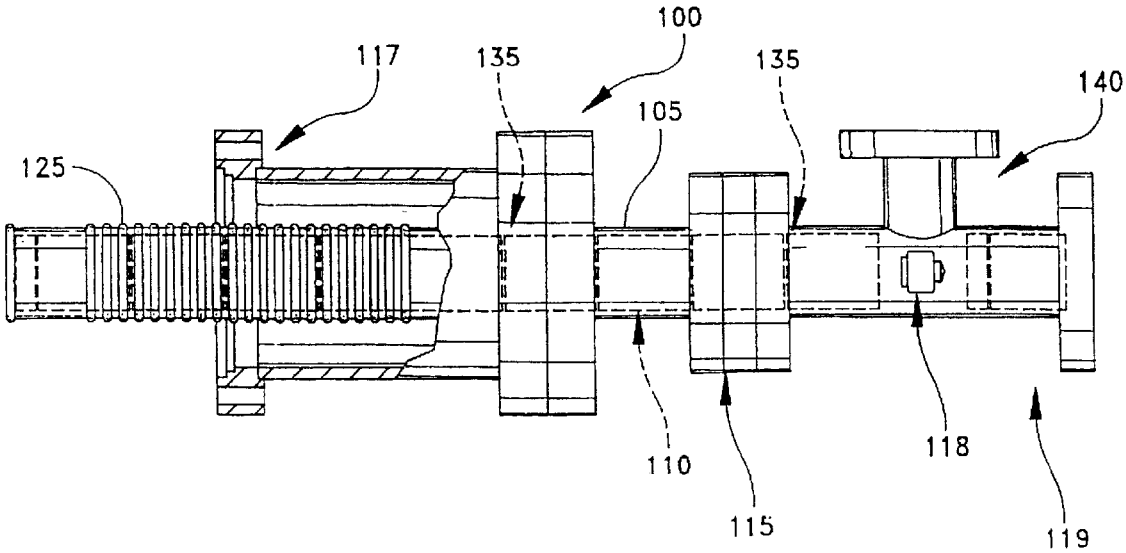
FIG. 19 is a side elevational view, partially in section and partially in phantom, of an antiproton injection/ejection snout assembly.
Figure 20:
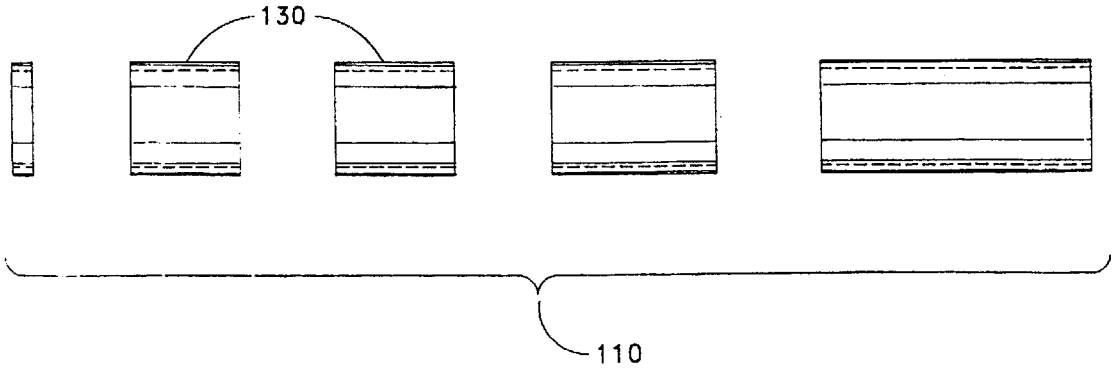
FIG. 20 is a side elevational view of an einsel lens electrode assembly formed in accordance with the present invention.

Referring to FIGS. 1 and 19–22, antiproton injection/ejection snout assembly 100 comprises a plurality of outer tubes 105, an einsel lens assembly 110, an electron gun 118, and a reaction trap 120. Snout assembly 100 is adapted to be sealingly attached to and detached from, vacuum shell 203. More particularly, outer tubes 105 are formed from a plurality of cylindrical sections that are fastenable, end-to-end, to create an elongate tubular structure 115 (FIGS. 1 and 19). Tubular structure 115 comprises a proximal portion 117 and a distal portion 119. A flexible bellows tube 125 is disposed at the proximal end of tubular structure 115 to help align and sealingly mate with snout interface port 226. Bellows tube 125 allows for compensation of minor tolerance mismatches between snout assembly 100 and snout interface port 226 during assembly of antiproton storage container 5 to snout assembly 100.

Einsel lens assembly 110 comprises a plurality of coaxially aligned, cylindrical tubes 130 that are formed from a highly conductive metal, e.g., copper or its alloys. Tubes 130 are sized so as to fit within bellows tube 125 and tubular structure 115 with gaps 135 defined between predetermined groups of tubes 130 so as to form strong electric field gradients adjacent to the edge portions of the tubes that are positioned on either side of a gap 135. Einsel lenses that are contemplated for use with the present invention are well known in the 10, art. Tubes 130 are individually interconnected to a source of high voltage electrical potential (shown generally at reference numeral 510 in FIG. 1). A mount 140 for a conventional electron gun 118 is located adjacent to distal end 119 of tubular structure 115. Electron gun 118 is installed after the injection of antiprotons into the trap for use in further cooling the antiprotons, as will hereinafter be disclosed in further detail. Distal portion 119 also includes mounting means for receiving ejected antiprotons, such as reaction trap 120 shown in FIGS. 1 and 21.

More particularly, reaction trap 120 is similarly constructed to antiproton storage container 5, inasmuch as it comprises a dewar assembly 201, a super conducting magnet 301, an electrode assembly 400, and control electronics 601. Dewar assembly 201 includes an outer vacuum shell 202 and at least two coolant reservoirs 207 and 208 that are arranged to withstand and maintain ultra-low, "cryogenic" temperatures, i.e., temperatures of no more than 100 degrees above absolute zero, as measured in degrees Kelvin. Outer vacuum shell 202 comprises a cylindrical shape having side access ports 214 and 216 that are adapted to provide hermetically sealed access to the interior of vacuum shell 202.

Figure 21:
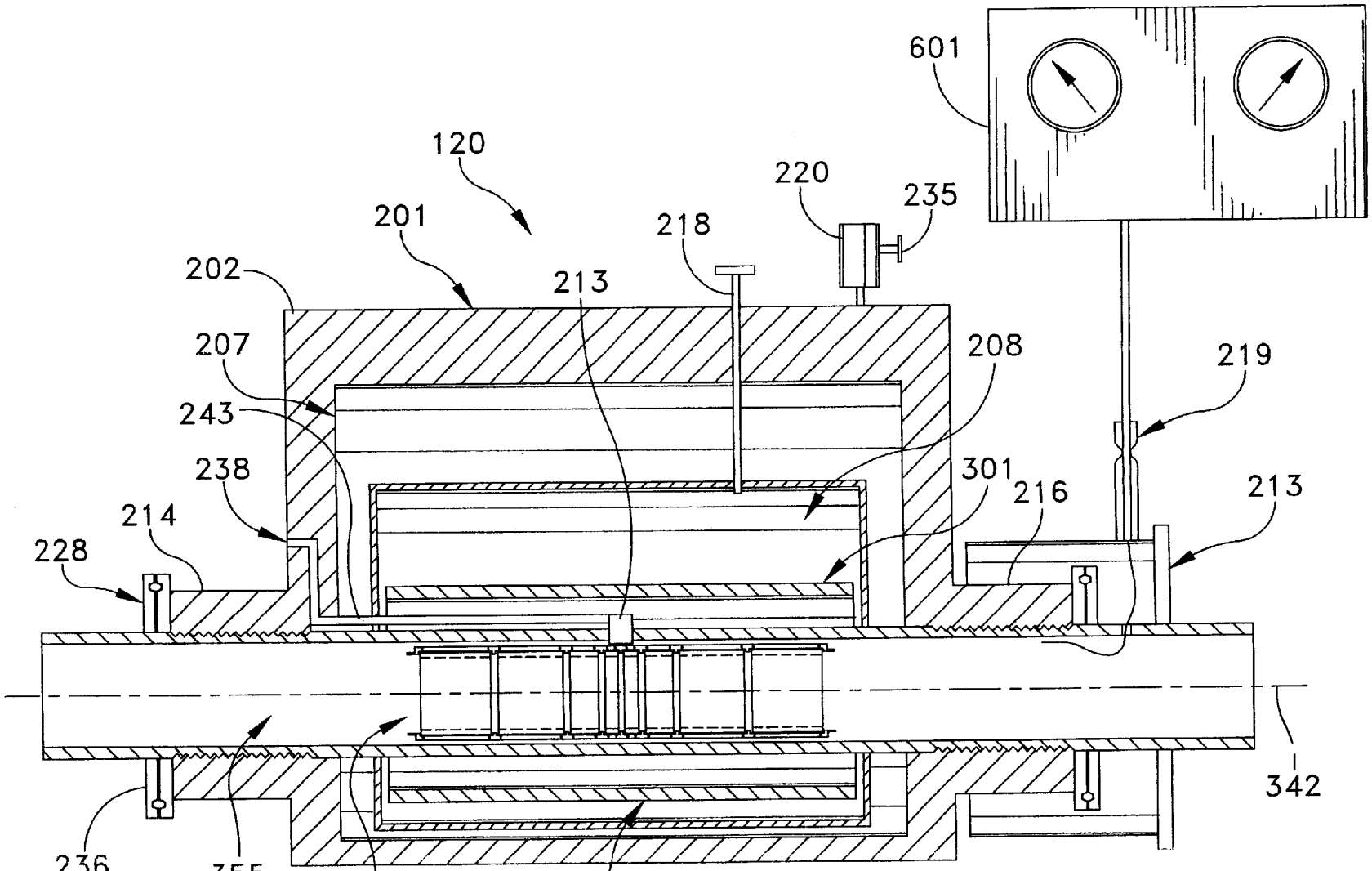
FIG. 21 is a cross-sectional view of the reaction trap shown in FIG. 1.

Vacuum shell 202 is typically formed from stainless steel or the like, with a cryogenic fill line 218 extending through its cylindrical side wall. A high voltage port 219 and a vacuum feed port 220 are formed on side access port 216 and outer vacuum shell 202, respectively, and a snout interface port 228 is formed as a portion of side access port 214 (FIG. 21). High voltage port 219 is adapted to provide electrical access to super conducting magnet assembly 301, an electrode assembly 400, and portions of control electronics 601 that are resident within the interior of reaction trap 120. High voltage port 219 may comprise any of the well known electrical interconnection devices that are suitable for use with ultra-low vacuum systems.

Vacuum feed port 220 is defined by an outwardly projecting tubular cylinder having a radially-outwardly projecting coupling flange 235. Snout interface port 228 is defined by a radially-outwardly projecting annular coupling flange 236 disposed on the terminal end of side access port 214. In one embodiment, a reactant material insertion port 238 is formed in the wall of vacuum shell 202, adjacent to side access port 214, and arranged in flow communication with an interior reaction-penning region 355 defined by super conducting magnet 301 and reaction trap electrode assembly 400 of reaction trap 120. In this embodiment, reactant material insertion port 238 is interconnected with reactant material exit port 213, via a passageway 243. Reactant material exit port 213 is positioned adjacent to reaction-penning region 355 so that reactant materials 575, e.g., any of the various actinides, may be selectively deposited in reaction-penning region 355. Of course, it will be understood that the reactant materials 575 and reactant material insertion port 238 may be wholly enclosed by vacuum shell 202 or be a portion of an auxiliary chamber or holding pen.

First reservoir 207 comprises a cylindrical wall that defines a hollow interior cavity within hollow cylindrical vacuum shell 202, and is adapted to contain a first coolant, e.g., liquid nitrogen. First reservoir 207 has an inner diameter sized so that second reservoir 208 may be disposed therewithin. A fill line (not shown) is disposed in fluid communication with the interior of first reservoir 207 to provide an opening for introducing the first coolant. Second reservoir 208 comprises a cylindrical wall that defines a hollow interior cavity within second reservoir 208. Cryogenic fill line 218 is disposed in fluid communication with the interior cavity of second reservoir 208 to provide an opening for introducing a second coolant, e.g., liquid helium, into second reservoir 208. Second reservoir 208 is sized so as to be coaxially disposed within first reservoir 207 and vacuum shell 202.

Figure 22:
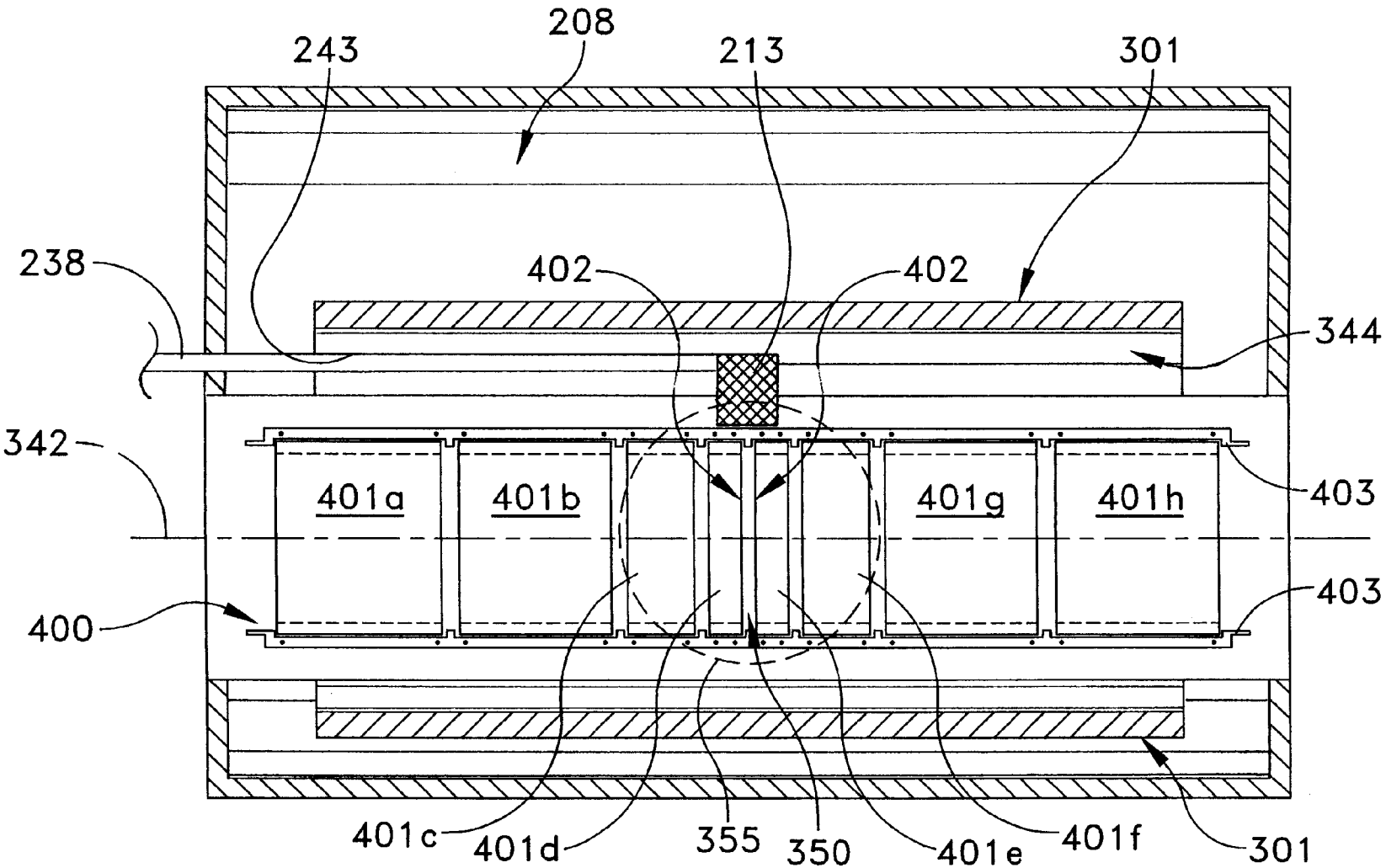
FIG. 22 is a cross-sectional view of a reaction trap electrode assembly positioned within the reaction trap shown in FIGS. 1 and 21.

Referring to FIGS. 21 and 22, super conducting magnet 301 and reaction trap electrode assembly 400 together form the functional elements of reaction trap 120. Super conducting magnet 301 typically comprises a cylindrical tube structure, and is formed from any one or more of the well known materials that are susceptible to super conductivity when placed at cryogenic temperatures. Super conducting magnet 301 comprises an open ended passageway 344 that is coaxially aligned with access ports 214 and 216 of vacuum shell 202 along a common longitudinal axis 342. An axial magnetic field on the order of about 2 to 4 Tesla is typically found in the region defined along longitudinal axis 342 of open ended passageway 344. Super conducting magnet 301 is supported within second reservoir 208 by mechanical brackets, or the like (not shown).

Figure 23:
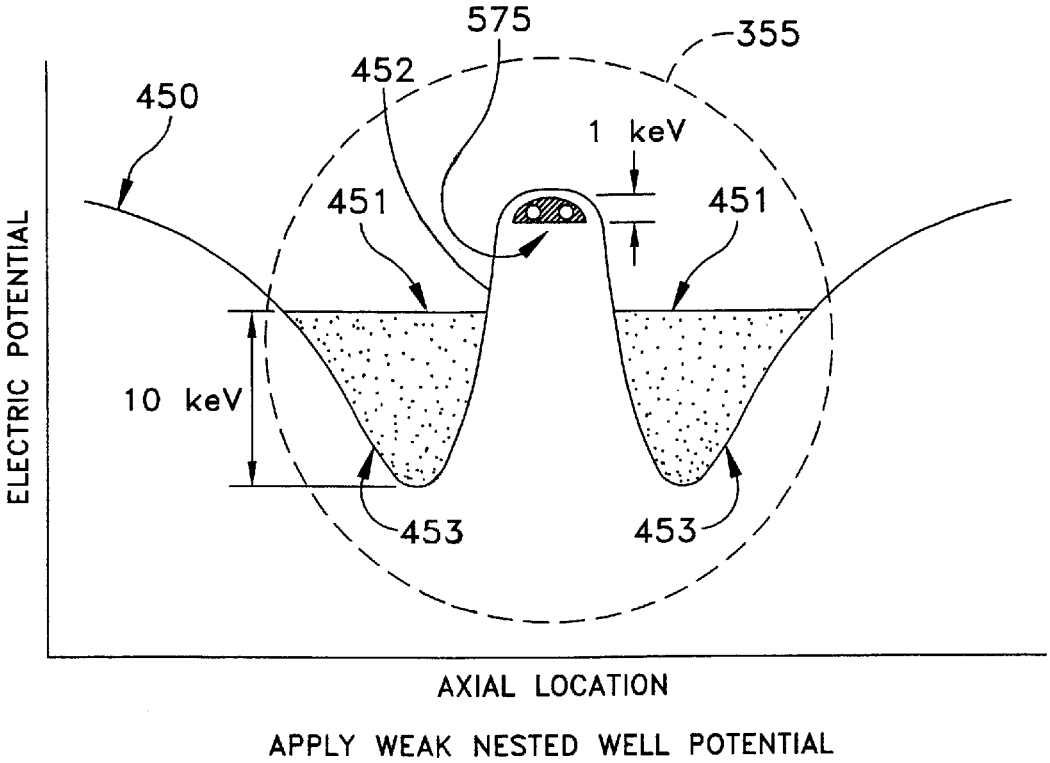
FIG. 23 is a graphical representation of dual nested potential wells of the type created in the reaction penning region of the reaction trap shown in FIGS. 1 and 21.
Figure 24:
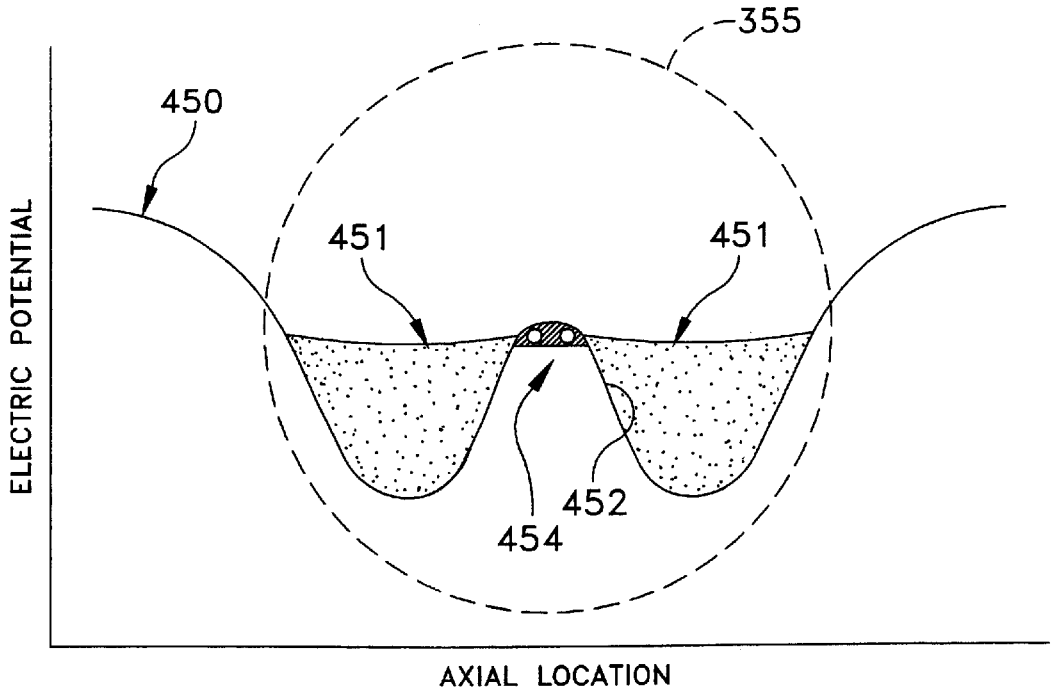
FIG. 24 is a graphical representation of dual nested potential wells and a central reaction zone of the type created in the reaction trap shown in FIGS. 1 and 21 when a reactant material is introduced into the reaction trap.

Referring to FIGS. 10–13 and 21–22, an electrode subassembly 400 is utilized in connection with reaction trap 120 that is substantially similar to that which is used in connection with antiproton storage container 5 disclosed hereinabove. Accordingly, reaction trap electrode assembly 400 includes electrodes 401 and spacer assembly 403. In this embodiment, eight electrodes, 401*a*, 401*b*, 401*c*, 401*d*, 401*e*, 401*f*, 401*g*, and 401*h* (40*ia–h*) are utilized. Electrodes 401*a–h* comprise a plurality of discrete, coaxially aligned cylindrical tubes, of differing longitudinal length, that are sized so as to fit into spacer assembly 403 within open ended passageway 344 of super conducting magnet 301. Electrodes 401 are typically formed from a highly conductive metal, such as copper or its alloys. Gap 350 is defined by the spaced-apart edges 402 of inner electrodes 401*d*, 401*e* (FIG. 22). The additional gaps disposed between inner electrodes 401*c*, 401*d*, 401*e* and 401*f* define reaction-penning region 355 in which effective electric potential wells (FIGS. 23 and 24) may be formed which are suitable for penning relatively large populations of antiprotons, and initiating, and sustaining energetic interactions between reactant materials 575 and the penned antiprotons. Electrodes 401 are individually interconnected to a source of high voltage electrical potential (shown generally at reference numeral 510 in FIG. 1) via conventional electrical conductors (not shown), so that each electrode may be independently energized as required during injection, storage, reaction and ejection of the plasma formed by the interaction of antiprotons and reactant materials 575.

More particularly, reaction-penning region 355 comprises open electrodes 401 arranged in a cylindrical geometry, with each of electrodes 401 having an electric potential on it. The potentials can be arranged symmetrically around the center of the reaction trap 120, i.e., around gap 350. In this way, the potentials are greatest at the ends of electrode assembly 401, i.e., at edges 402*a–h* of electrodes 401*a* and 401*h*, thus confining particles with opposite sign charges toward the center of reaction trap 120, i.e., toward gap 350. Radial confinement is provided by the uniform axial magnetic field of about 2 to 4 Tesla defined along the trap's symmetry axis, i.e., along longitudinal axis 342 of open ended passageway 344.

The highest density of antiprotons in reaction trap 120 is achieved just below the Brillouin limit. The conditions necessary to arrive at the Brillouin limit are found by equating the magnetic energy density in the field to the total energy density of the particles confined in reaction trap 120. For example, at 1 tesla magnetic field, this density is $2.6\times10^9$ antiprotons per cubic centimeter. Well below this limit, particle motions are described adequately by a purely harmonic field, which is known in the art as "Brillouin motion". An antiproton cloud is confined radially in reaction trap 120 by the qvB force due to the axial magnetic field created by super conducting magnet 301. For large antiproton densities, the space charge tends to expand the cloud radially. The condition for Brillouin flow can be expressed in terms of the radial component of F=ma:

$$q\omega_r r B_z - k\ r = m\omega_r^2 r \qquad \text{Eq. (1)}$$

where $q=1.6\times10^{-19}$ coulombs, m is the antiproton mass, r is distance from the symmetry axis, and k is proportional to the charge density. For example, a spherical cloud with a density $n=10^9$ antiprotons/cm$^3$ corresponds to a value of k=1100 eV/cm$^2$. The radial size of the antiproton cloud is stable for two well-defined values of the angular velocity $(\omega)_r$, provided that the value of k is small enough to allow two real roots of eq. (1). Thus the Brillouin circulation pattern of antiprotons within reaction trap 120 resembles rigid body rotation.

Electrodes 401*a–h* in reaction trap 120 each have a radius in the range from about 1.5 cm to 6 cm or so, and cover a length of about 40 cm. A very deep electrical potential well is created within reaction trap 120, via selective energization of electrodes 401*a*–401*h* in electrode assembly 401, thereby forming a nearly spherical antiproton distribution, with an axial extent comparable to the 2 cm radius of electrodes 401*a–h*. A magnetic field of 2 to 4 Tesla is selected to set up conditions for Brillouin motion within reaction trap 120. Magnetron motion is produced entirely by the radial component of the electric field set up by electrodes 401*a–h*, in conjunction with the axial magnetic field. For example, with a space charge field characterized by k=500 eV/cm$^2$, the antiproton path extends over a larger region of the trap. With a space charge k=1000 eV/cm$^2$, the antiprotons escape radially from reaction trap 120, and only restricted choices of initial velocity will result in radial containment. Antiprotons with an azimuthal angular rotation of $45<(\omega)_r,55$ radians/$\mu$sec remain in reaction trap 120, while antiprotons with initial angular frequencies of 40 to 60 radians/$\mu$sec escape.

In one embodiment of the invention, reaction trap 120 includes superconducting magnet 301 with a magnetic field in the 1–2 tesla range and an electrode assembly 401 of radius 3–5 cm and length 40 cm in passageway 344 of superconducting magnet 301. Fuel pellets formed from a reactant material 575, e.g., any of the various actinides, are selectively deposited in reaction-penning region 355 at the center of reaction trap 120, via reactant material insertion port 238 and passageway 243 that interconnect the center of reaction trap 120, i.e,. adjacent to electrodes 401*c*, 401*d*, 401*e*, 401*f*, to the environment outside of vacuum shell 202.

Various characteristic frequencies for describing stable motion, and that are associated with a preferred reaction trap 120 are: $(\omega)_c$=qB/m=96 rad/$\mu$sec (cyclotron frequency with 10 kG); $(\omega)_t$=sqrt($k_{pl}$/m)=31 rad/$\mu$sec(frequency of large-amplitude oscillations of a test particle in a spherical cloud; $k_{pl}$=1000 eV/cm$^2$ for n=8 $10^8$ antiprotons/cm$^3$); $(\omega)_p$=sqrt(n $e^2/(e_0$ m)=41 rad/$\mu$sec(plasma frequency for n=8× $10^8$antiprotons/cm$^3$); $(\omega)_z$=sqrt($k_z$/m)=49 rad/$\mu$sec(single particle axial frequency, due to electrode fields only; with $k_z$=2500 eV/cm$^2$ ($d^2V/dz^2$ from FIG. 2)); $(\omega)_p$ (max)=$(\omega)_c$/sqrt(2)=68 rad/$\mu$sec(highest possible plasma frequency consistent with 10 kGauss magnetic field); and (Brillouin)=$B^2/(2\mu_0 Mc^2)$=2.65 $10^9$pbars/cm3 (Brillouin density limit with 10 kG. The plasma frequency applies to small-amplitude (thermal) oscillations of an antiproton, depending only on the local charge density. Cloud stability also depends on the cloud shape, which is represented in the above list as the frequency for large-amplitude oscillations. The frequency ratio $\omega_z/\omega_p$ is related to the aspect ratio $\alpha=z_0/r_0$ of the antiproton cloud. Using the foregoing values results in $\omega_z/\omega_p$=49/31=1.7 (=sqrt(3) for a spherical cloud). Typically, the largest possible value of $\omega_z/\omega_p$=1 corresponds to an aspect ratio $\alpha$=0, i.e. a thin disk centered on z=0. In general, eq. (1) can be written as a relation among the plasma, cloud rotation and cyclotron frequencies and be valid for any cloud aspect ratio, as follows:

$$\omega_p=\omega_r(\omega_c-\omega_r) \qquad \text{Eq. 2}$$

Equation (1) implies that individual antiprotons rotate about the symmetry axis with no variation in radius, with two possible choices for angular velocity Often, two clear minima in the variation in radius $R_{max}-R_{min}$, for $(\omega)_r$=20 and 120 rad/μsec, for tract 2 (initial radius 0.185 cm). These angular velocities correspond to the two roots of equation (1). These minima are not observed for tracks with larger initial radius, implying that anharmonic components of the reaction trap electric field make equation (1) a poor approximation. Specifically, the "spring constant" k varies with both radius and axial position, so that pure Brillouin motion is not achievable.

The variation in radius is often practically constant, for rotation angular velocities within about 30% of $\omega_c/2$=70 rad/μsec, i.e., half of the cyclotron frequency, even for tracks with large initial radius. The following parameters are adopted, to calculate the antiproton motion in reaction trap 120: B=5 Tesla=>$\omega_c$=470 rad/μsec, n=6.6×$10^{10}$ antiprotons/$cm^3$ (Brillouin limit);$\omega_r=\omega_c/2$=235 rad/μsec(cloud rotation angular velocity), $\omega_z$=16 rad/μsec, $Z_{max}$=11.7 cm (axial angular frequency, amplitude).

FIG. 22 represents a graph of electric potential versus axial location, for a double potential well of the type formed within penning region 355, which holds antiprotons before reactant material 575 is introduced into reaction trap 120. The antiproton clouds are distributed in such a way as to cancel the z-components of the fields produced by electrode assembly 401 and by the space charge. The space charge density is characterized by a field gradient of, e.g., k=480 eV/$cm^2$.

The minimal radial variations of the antiprotons occur for rotation frequencies of about 5 and 150 rad/μsec. These rotation frequencies differ from those of a single well, because the space charge density is lower when the antiprotons are distributed over two wells. Referring to equation (1), in the limiting case of a negligible space charge k=0, one of the two rotations is $\omega_r$=0 (and the other one is $\omega_c$). Thus, with an antiproton cloud space charge characterized by a field gradient k=480 eV/$cm^2$, radial variations are small enough that most tracks will remain in reaction trap 120.

Referring once again to FIGS. 1, 2, and 3, antiproton storage container 5 is assembled in the following manner. Each magnet support 304 is assembled to base plate 240 with a magnet 302 assembled to it. More particularly, two inner magnet supports 304, comprising circumferentially arranged projections 336 on their yokes 332 are first fastened to base plate 240. Magnet supports 304 are disposed in confronting-relation to one another so that projections 336 project toward one another. Each magnet support 304 is then oriented so as to be positioned in confronting substantially perpendicular relation to the bottom surface of base plate 240. Inner magnet supports 304 are then moved toward base plate 240 until cold fingers 330 engage the surface of base plate 240. In this position, plurality of blind bores 334 of magnet supports 304 are disposed in coaxially aligned relation with bores 241 of base plate 240 (FIG. 9). Fasteners, e.g., thermally conductive screws or bolts, are then driven through the bores to releasably fasten inner magnet supports 304 to base plate 240. A magnet 302 is then positioned within each yoke 332 so that it is supported by projections 336. The inner most magnets 302 are supported by projections 336, and comprise magnetic polarizations as disclosed hereinabove (one polarized radially-inwardly and one polarized radially-outwardly). Gap 315 is formed between these two inner magnets, and creates about a 4 centimeter space between the inner magnets. It will be understood that this distance may be altered by adjusting the longitudinal position of magnets 302 within yokes 332 or by changing the relative spacing of the inner magnet supports on base plate 240. Two outer magnet supports 304 are then fastened to base plate 240, one each on either side of the two inner magnet supports. A magnet 302 is then positioned within each yoke 332 of the outer magnet supports. The magnets 302 that are disposed in the outer magnets supports 304 are longitudinally polarized so that a net longitudinal field component is directed along the axis of open ended passageway 320.

Next, electrode subassembly 400 is arranged so that electrodes 401*a–d* are disposed within magnet mount 405. More particularly, electrodes 401*b* and 401*c* are first inserted into opposite side openings in magnet mount 405. During the assembly of electrodes 401*a–d* within magnet mount 405, gap 406 is formed between electrodes 401*b* and 401*c* by the interaction of edges 402 of electrodes 401*b* and 401*c* with internal shoulders 402A and 402B of magnet mount 405. In this way, gap 406 will substantially correspond to gap 315 when electrode assembly 400 is assembled to magnet assembly 300. Gap 406 is disposed substantially centrally within the magnet mount 405 (FIG. 11). Spacer bars 407 are then assembled to the outer sides of magnet mount 405 prior to assembly to magnets 302. After being fully assembled, electrode subassembly 400 is positioned within open ended passageway 320 of magnets 302. More particularly, electrode subassembly 400 is oriented so as to be disposed in confronting coaxially aligned relation to longitudinal axis 317 of open ended passageway 320. From this position, electrode subassembly 400 is then moved toward and into open ended passageway 320. Electrode subassembly 400 is slid through open ended passageway 320 until the penning region defined by the gaps between electrodes 401*b* and 401*c* is centrally disposed within gap 315.

Next, shutter mechanism 700 is assembled to base plate 240. More particularly, shutter mechanism 700 is first pivotally assembled to shutter support 709. Blind bore 711 is oriented so as to be disposed in opposing coaxial relation with an outer most bore 241 on base plate 240. Shutter support 709 is then fastened to base plate 240 by means of a bolt 242. In this initial, "at rest position" shutter 703 is biased over open ended passageway 320 and by return spring 727. Coiled conductor 706 may then be electrically interconnected to a selectively energizable source of electrical potential (shown generally at reference numeral 510 in FIG. 1).

With magnet assembly 300 and shutter mechanism 700 fastened to base plate 240, base plate 240 is then sealably fastened to the edge of second reservoir 209. Base plate 240 may be sealingly fastened to second reservoir 209 by means of indium seals or the like to form hermetically sealed joints therebetween. Tail assembly 212 is then assembled to first reservoir 206 and second reservoir 209 so as to complete dewar assembly 200. It will be understood that the various electrical and vacuum connections that are necessary for the operation of antiproton storage container 5 must be completed prior to the assembly of tail assembly 212. For example, electrode assembly 400 and detector 600 will be electrically interconnected to selectively energizable sources of electric potential of the type known in the art (shown generally at reference 510 in FIG. 1). For example, a regulated power supply, such as the one manufactured by Bertran, or a battery operated version of the same or similar power supply, has been found to be adequate for use with the present invention.

Referring again to FIGS. 1, 2, and 3, second tail 251 is positioned in confronting coaxial relation with second reservoir 209. From this position second tail 251 is then moved toward base plate 240 of second reservoir 209, and around magnet assembly 300, until annular flange 284 engages bottom 239 of second reservoir 209. Second tail 251 is sealingly fastened to second reservoir 209 by means of indium seals or the like to form a hermetically sealed interface. The interior of second tail 251 forms a cavity that surrounds magnet assembly 300. A similar assembly operation is then completed between first tail 248 and first reservoir 206, i.e., first tail 248 is moved toward first reservoir 206 (and around second tail 251) until annular flange 273 engages the bottom end surface of hollow cylindrical wall 227 where it is hermetically sealed.

It will be understood that the longitudinal axis of snout interface port 226, beam port 276, beam port 287, and longitudinal axis 317 of open ended passageway 320 are all disposed in coaxial alignment with one another. It will also be understood that the various mating and interface surfaces between the various tails and snout assembly are releasably and sealably fastened to one another so as to form a gas tight interconnection. In its fully assembled state, antiproton storage container 5 comprises a substantially closed cylinder having a height of about 1 to 1.5 meters, a diameter of about 0.3 to 0.5 meters, and a fully charged weight of about 23 kilograms. In other words, antiproton storage container 5 is of a size, shape, and weight that is suitable for transportation by conventional terrestrial or air means, or inclusion in a spacecraft.

After antiproton storage container 5 has been fully assembled, the cavities formed between outer vacuum shell 203, first tail 248 and second tail 251 are evacuated to an ultra-low pressure in the range from approximately $10^{-9}$ to $10^{-13}$ torr. First and second reservoirs 206 and 209 are then filled with liquid nitrogen and liquid helium, respectively, so as to create an ultra-low, cryogenic temperature environment within dewar assembly 200. It will be understood that base plate 240 will be cooled by the liquid helium to cryogenic temperatures of about 1–4 degrees Kelvin, and as a consequence, magnet supports 304 and magnets 302 will also be disposed at a substantially cryogenic temperature. The filling of first and second reservoirs 206 and 209 is accomplished via tubular fill lines 221 and 224, respectively.

Injection/ejection snout assembly 100 is assembled separate from antiproton storage container 5 by positioning einsel lens assembly 110 within bellows 125 in tubular structure 115. Snout assembly 100 may be sealingly assembled and disassembled from snout interface port 226 by orienting tubular structure 115 so as to be disposed in coaxially aligned relation to tubular cylinder 266. Tubular structure 115 is then moved toward interface port 226 until annular coupling flange 233 engages a corresponding coupling flange disposed on proximal portion 117. With snout assembly 100 sealingly fastened to snout interface port 226, and the interior of both snout assembly 100 and antiproton storage container 5 evacuated to an ultra-low pressure in the range from approximately $10^{-10}$ to $10^{-13}$ torr, antiprotons may be injected into the antiproton trap from a conventional source of antiprotons, such as a synchrotron or the like.

More particularly, and once again referring to FIGS. 1, 2, and 20, distal portion 119 of snout assembly 100 is sealingly fastened to the source of antiprotons so that antiprotons will enter distal portion 119 of snout assembly 100. It will be understood that antiprotons are produced by, e.g., a synchrotron, at very high energies in a broad band centered about 5–10 GeV, with the actual energy of the antiprotons being dependent upon the production energy. It is also known that beams of antiprotons can be made available at lower beam energies, e.g., in the range of about 50 keV to 5 Megaelectronvolts (5 MeV). For use in connection with antiproton storage container 5, a beam of antiprotons having energies less than 100 keV are preferred.

Next, Einsel lens assembly 110 is selectively energized so as to provide a differential electrical gradient along the length of tubular structure 115 to urge the antiprotons along the longitudinal axis of snout assembly 100 and toward open ended passageway 320 of magnet subassembly 300. As this occurs, electrodes 401*a* and 401*b* are energized so as to provide a differential electric field gradient across the end of open ended passageway 320 that is most distant from snout assembly 100. At the same time, electrodes 401*c* and 401*d* are either not energized, or energized so as to provide a first longitudinally inwardly directed electric field gradient so as to urge the antiprotons entering open ended passageway 320 toward electrodes 401*a* and 401*b*. It will be understood that during the injection of antiprotons into the antiproton trap, shutter mechanism 700 is positioned in its retracted location against the biasing force of return spring 712 so as to clear a path for the antiprotons.

After a quantity of antiprotons, e.g., between about $10^{11}$ and $10^{13}$ antiprotons, have moved through open ended passageway 320 toward electrodes 401*a* and 401*b*, electrodes 401*c* and/or 401*d* are selectively energized so as to provide a second differential electrical gradient within open ended passageway 320. In this way, the antiprotons are trapped in a potential well formed in the penning region located within gap 315 and between electrodes 401*b* and 401*c* (FIG. 3). Once this has occurred, coiled conductor 706 is de-energized so that return spring 712 biases shutter 703 back to its rest position between open ended passageway 320 and beam port 287. Snout assembly 100 may then be sealingly detached from snout interface port 226. It will be understood that during the unfastening and removal of snout assembly 100 is done by conventional means so as to guard the integrity of the vacuum formed in antiproton storage container 5 from being compromised appreciably.

With the $10^{11}$ to $10^{13}$ antiprotons disposed within the penning region of the antiproton trap, their presence may be detected by the circuit of detector 600 as disclosed hereinabove. In order to reduce the thermal energy associated with the antiprotons, electron gun 118 is positioned in mount 140 within distal portion 119 of snout assembly 100. Electron gun 118 injects electrons into Einsel lens assembly 110 where they are accelerated along the longitudinal axis of snout assembly 100, through open ended passageway 320 and into the penning region of the antiproton trap. The accelerated electrons collide with the antiprotons and absorb kinetic energy from them. This absorbed kinetic energy is then radiated out of the system by the electrons due to synchrotron radiation caused by the electrons precessing in the magnetic fields of magnets 302. It will be understood that there is no annihilation caused by the interaction between the electrons and antiprotons since they are dissimilar elementary particles.

The application of ultra-low temperatures and ultra-low pressures within antiproton storage container 5, coupled with the injection of cooling electrons, via electron gun 118, combine to maintain the antiprotons at significantly reduced kinetic energies that are suitable for relatively long term storage within the antiproton trap of antiproton storage container 5.

After antiproton storage container 5 has been delivered to a desired location, e.g., a launch site for a spacecraft or an industrial facility, the previous process is reversed so as to deposit the antiprotons into reaction trap 120. More particularly, snout assembly 100 is reattached to antiproton storage container 5 and evacuated to a comparable vacuum as that resident within antiproton storage container 5. Side access port 214 of reaction trap 120 is then sealingly attached to distal portion 119 of snout assembly 100, and reaction trap 120 is evacuated to a comparable vacuum as that resident within antiproton storage container 5.

Next, antiprotons are ejected from antiproton storage container 5 into reaction trap 120 by first re-energizing coiled conductor 706 so that shutter 703 is again pivoted out of its rest position between open ended passageway 320 and beam port 287. Storage container electrodes 401*c* and 401*d* of antiproton storage container 5 are de-energized thereby providing a differential electrical field gradient between antiproton storage container electrodes 401*a* and 401*b* that urges the antiprotons out of the penning region of the storage container antiproton trap and toward beam port 287. The antiprotons are moved along the longitudinal axis of snout assembly 100 by Einsel lens assembly 110, and into reaction trap 120 where they are introduced into reaction trap penning region 355 where they are contained within a dual potential well, of the type shown in FIG. 23.

Reactant material 575 may be introduced into penning region 355 to selectively interact with the antiprotons, e.g., to create a plasma burn for use as a propellant for a spacecraft. More particularly, FIGS. 24 graphically illustrate one technique employed to manipulate antiprotons after injection of reactant material 575, in order to create a plasma burn. The antiprotons are initially confined in a nested double well electric potential structure (identified generally at reference numeral 450 in FIGS. 23 and 24). In one embodiment of reaction trap 120, two clouds of antiprotons (identified generally at reference numeral 451 in FIGS. 23 and 24) are separated by approximately 17 centimeters center-to-center. In each of the two clouds, the antiprotons are executing cyclotron and magnetron motion. Preferably, about 1012 antiprotons can be contained in this fashion in reaction trap 120, at densities of up to 50% of the Brillouin limit, or for a 1 tesla magnetic field, $1\times10^9$ antiprotons/cubic centimeter. As a consequence, the confining volume of reaction-penning region 355 of reaction trap 120 is often approximately 1000 cubic centimeters, or more, with potential well depths of at least 20 kilovolts.

In practice, reactant material 575 will be charged, and drawn through passageway 243 by a weak electric field. As reactant material 575 enters reaction-penning region 355, via exit port 213, it is attracted by an electrical potential emanating from electrodes 401*d* and 401*e*, i.e., the central electrodes. Gap 350 allows the reactant material 575 to enter into the reaction-penning region 355. A course mesh or the like (not shown) may be arranged within reaction trap 120, between exit port 213 and gap 350, so as to regulate the transfer of reactant material 575 from exit port 213 to reaction-penning region 355.

The next step is to reduce the center potential barrier, i.e., the barrier that separates the antiproton clouds (identified generally at reference numeral 452 in FIGS. 23 and 24) allowing the antiproton clouds 451 to merge inwardly and envelop reactant material 575 (FIG. 26). As this occurs, plasma is created, and the potentials on electrode assembly 401 of reaction trap 120 are restored to a nested well configuration (FIG. 23) so as to once again separate the clouds of antiprotons. $10^9$ antiprotons can heat and ionize the reactant material 575 to temperature of 7–9 eV or more depending upon the choice of reactant material 575.

For example, reaction-penning region 355 is often raised to about a 1 kilovolt positive potential, in order to confine Li++ ions. The outer satellite potential wells, i.e., the wells 453 on either side of center potential barrier 452 are set at a depth of about negative 10 kV, holding the remaining antiprotons and electrons drawn out of the central ionization zone (identified generally at reference numeral 454 in FIG. 24). Because the temperature of the antiprotons is as high as 10 keV, they will commute between satellite wells 453, moving through the positive plasma that is centrally confined within reaction-penning region 355.

The plasma is nearly transparent, i.e., nonreactive, to the antiprotons, as the energy loss mechanism in an ionized medium is very weak. Since the inward magnetic pressure often exceeds the outward kinetic pressure by three orders of magnitude, the resultant plasma is very stable. The lifetime of the plasma is limited by radiation (bremsstrahlung) cooling, and not thermal or collisional effects. In one embodiment of the reaction trap, $10^9$ antiprotons are consumed in one cycle of reaction trap 120,. Thus, with $10^{12}$ antiprotons, reaction trap 120 may run continuously for up to 1000 cycles, in effect rendering a plasma lifetime of up to 7100 seconds, or about 2 hours.

One application of reaction trap 120 is to develop an intense stream of ions, i.e., a plasma, for extraction as a space thruster. Ions may be extracted efficiently superposing a 50 MHz, 10 volt field on electrodes 401*a*, 401*b*, 401*g*, 401*h* potentials to draw the electrons into satellite wells 453, and away from positive ions created during the interaction of the antiprotons and reactant material 575. In order to extract ions, the potentials on electrodes 401*c* and 401*d* are lowered from +1 kiloelectron volt to zero volts. At the same time, the potentials on electrodes 401*a* and 401*b* are raised from −10 keV to −1 keV. This can be done over a period of time consistent with the desired spill length for a given thruster application. This procedure results in ions being accelerated up to an energy of 1 keV. To diagnose the stream's characteristics, the ions may be sent through a set of focusing grids (not shown) to impinge on an ion detector, e.g. micro-channel plate, where they may be counted and compared to a standard. The cyclotron radius of the ions in a 1 tesla magnetic field at 1 keV energy is about 1.1 mm, which roughly defines the transverse area of the beam of ejected plasma (not shown). The angular divergence of the beam of ejected plasma is roughly 4 cm/20 cm, or 200 mrad. Hence, the emittance of the beam of ejected plasma is about 760 $mm^2$-mrad.

To preserve this emittance, two Einzel lenses of the type disclosed in detail hereinabove, are introduced along with a magnetic coil, adjacent to electrode 401*h* (not shown). With the magnetic field of the coil at 0.2 tesla, the radius of the beam of ejected plasma expands to 5.5 mm, and with appropriate voltages on the Einzel lenses(less than 1 kV), the beam of ejected plasma divergence should be about 8 mrad. Thus reaction trap 120 can produce a well collimated beam of ejected plasma with transverse dimensions of about 1 cm.

The spill width of the extracted ion beam of ejected plasma can be varied, depending on performance schedules, e.g. firing sequences for a thruster. Depending on the actual number of total antiprotons loaded, and numbers required per spill to maintain temperature conditions, lifetimes may be reduced to about 2 hours.

ADVANTAGES OF THE INVENTION

Numerous advantages are obtained by employing the present invention. For one thing, the present invention provides a storage container that is adapted for confining, storing, and transporting antiprotons. For another thing, a storage container formed in accordance with the present invention is capable of maintaining an effective population of antiprotons, at sufficient population levels, to provide adequate quantities for use in a reaction trap for the creation of plasma.

It is to be understood that the present invention is by no means limited to the precise constructions herein disclosed and shown in the drawings, but also comprises any modifications or equivalents within the scope of the claims.

What is claimed is:

1. A reaction trap comprising:

a dewar having an evacuated cavity and a cryogenic cold wall;

an antiproton trap mounted within said dewar and thermally interconnected with said cold wall, said antiproton trap defining at least two antiproton penning regions and a reaction region;

a reactant insertion port, a reactant exit port and a passageway extending therebetween that are defined through said dewar and said antiproton trap, wherein said reactant exit port is positioned adjacent to said reaction region of said antiproton trap;

a sealable access port selectively providing access to said antiproton trap for selective introduction of antiprotons into said antiproton penning regions; and a sealable exit port selectively providing egress from said antiproton trap for selective discharge of reaction by-products formed within said reaction region.

2. A reaction trap according to claim 1 wherein said reaction trap comprises a super conducting magnet having a longitudinally extending open ended passageway disposed therethrough, wherein said at least two antiproton panning regions and said reaction region are positioned within said open ended passageway, and further wherein a magnetic field generated by said super conducting magnet provides a substantially longitudinally oriented magnetic field at said at least two antiproton penning regions and said reaction region.

3. A reaction trap according to claim 2 wherein said at least two antiproton penning regions comprises axial magnetic fields in the range from about 2 to 4 Tesla.

4. A reaction trap according to claim 3 wherein said at least two antiproton penning regions comprises a plurality of hollow electrodes that are coaxially positioned within said open ended passageway of said super conducting magnet thereby forming an inner passageway, said plurality of hollow electrodes being electrically insulated from said super conducting magnet and positioned so that at least one of said hollow electrodes is disposed on a first side of said antiproton penning regions and at least one of said electrodes is disposed on a second side of said antiproton penning regions; and electrical conductors connected to said plurality of hollow electrodes so as to form an electrical circuit, wherein said electrical conductors are selectively connectable to a source of electrical potential whereby said plurality of hollow electrodes are selectively energizable so as to selectively provide electric fields within in said Inner passageway.

5. A reaction trap according to claim 4 wherein said antiproton penning regions within said open ended passageway are defined by at least two gaps between two of said plurality of electrodes.

6. A reaction trap according to claim 1 wherein said reactant insertion port is formed in a wall of said dewar and arranged in flow communication with said penning regions.

7. A reaction trap according to claim 1 wherein said reactant exit port is positioned adjacent to said penning regions so that reactant materials may be selectively deposited in said penning regions.

8. A reaction trap according to claim 1 wherein said antiproton trap comprises a super conducting magnet and a reaction trap electrode assembly.

9. A reaction trap according to claim 8 wherein said super conducting magnet comprises a cylindrical tube structure that defines an open ended passageway that is coaxially aligned with said sealable access port along a common longitudinal axis.

10. A reaction trap according to claim 9 wherein said super conducting magnet comprises axial magnetic fields in the range from about 2 to about 4 Tesla.

11. A reaction trap according to claim 8 wherein said reaction trap electrode assembly comprises a plurality of discrete coaxially aligned cylindrical tubes of differing longitudinal length that are each sized so as to be received within said super conducting magnet.

12. A reaction trap according to claim 11 wherein said electrode assembly defines at least two antiproton penning regions.

13. A reaction trap according to claim 11 wherein said electrode assembly defines at least two gaps between spaced-apart edges of said electrodes so as to create effective electric potential wells for penning relatively large populations of antiprotons, and initiating, and sustaining energetic interactions between a reactant material and said relatively large populations of antiprotons.

14. A reaction trap according to claim 13 wherein said electrodes are individually interconnected to a source of high voltage electrical potential so that each of said electrodes may be independently energized during injection, storage, reaction and ejection of a plasma formed by the interaction of said antiprotons and said reactant material.

15. A reaction trap according to claim 13 wherein said antiproton penning regions comprises a plurality of open cylindrical electrodes with each of said electrodes having an electric potential arranged symmetrically about a center of said reaction trap so as to confine charged particles with opposite sign charges toward said center of said reaction trap.

16. A reaction trap according to claim 13 wherein the highest density of antiprotons in said reaction trap is achieved just below the Brillouin limit so that said antiprotons are distributed in such a way as to cancel the z-components of the fields produced by said electrode assembly.

17. A method for controlled interaction between antimatter and matter comprising:

(A) providing a first and a second antiproton confinement regions;

(B) maintaining said antiproton confinement regions at an ultra-low pressure and cryogenic temperature;

(C) establishing a controllable magnetic field in each of said antiproton confinement regions;

(D) establishing controllable electric fields in each of said antiproton confinement regions;

(E) controlling said electric fields to urge antiprotons from said first confinement region into said second antiproton confinement region;

(F) modifying said electric fields to retain antiprotons in said second antiproton confinement region in a dual nested electric potential wells;

(G) introducing a reactant material into a region of space adjacent to said dual nested electric potential wells;

(H) modifying at least one of said electric fields to urge said antiprotons in said antiproton confinement regions toward said reactant material so as to controllably annihilate said reactant material.

18. A system for controlled interaction of matter and antimatter comprising:

a container for transporting antiprotons comprising:

a first dewar having an evacuated cavity and a cryogenic cold wall;

a plurality of thermally conductive supports in thermal connection with said cold wall and extending into said cavity;

a first antiproton trap mounted on said extending supports within said cavity; and a sealable cavity access port selectively providing access to the cavity for selective introduction into and removal from the cavity of said antiprotons; and a reaction trap comprising:

a second dewar having an evacuated cavity and a cryogenic cold wall;

a second antiproton trap mounted within said second dewar and thermally interconnected with said cold wall, said second antiproton trap defining an antiproton penning region and a reaction region;

a reactant insertion port, a reactant exit port and a passageway extending therebetween that are defined through said second dewar and said antiproton trap wherein said reactant exit port is positioned adjacent to said reaction region of said second antiproton trap;

a sealable access port selectively providing access from said sealable cavity access port of said first antiproton trap to said second antiproton trap for selective introduction of antiprotons into said antiproton penning region; and a sealable exit port selectively providing egress from said second antiproton trap for selective discharge of reaction by-products formed within said reaction region.

* * * * *

UNITED STATES PATENT AND TRADEMARK OFFICE

CERTIFICATE OF CORRECTION

PATENT NO. : 6,414,331 B1
DATED : July 2, 2002
INVENTOR(S) : Smith et al.

It is certified that error appears in the above-identified patent and that said Letters Patent is hereby corrected as shown below:

Column 1,
Line 10, insert the following:
-- GOVERNMENT SPONSORSHIP

This invention was made with support from NASA under Contract No. JPL 958301 and AFOSR under Contract No. F49620-94-1-0223. The Government has certain rights in the invention. --

Signed and Sealed this

Twenty-fifth Day of January, 2005

JON W. DUDAS
*Director of the United States Patent and Trademark Office*